US012798630B2

(12) United States Patent
Guan et al.

(10) Patent No.: US 12,798,630 B2
(45) Date of Patent: Nov. 17, 2026

(54) RAIL VEHICLE

(71) Applicant: BYD COMPANY LIMITED, Shenzhen (CN)

(72) Inventors: Zejun Guan, Shenzhen (CN); Junfu Luo, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 363 days.

(21) Appl. No.: 18/612,018

(22) Filed: Mar. 21, 2024

(65) Prior Publication Data

US 2024/0227876 A1 Jul. 11, 2024

Related U.S. Application Data

(63) Continuation of application No. PCT/CN2022/126476, filed on Oct. 20, 2022.

(30) Foreign Application Priority Data

Nov. 15, 2021 (CN) ..... 202111348365.X

(51) Int. Cl.
*B61D 19/00* (2006.01)
*B61D 23/02* (2006.01)

(52) U.S. Cl.
CPC ..... *B61D 19/004* (2013.01); *B61D 23/02* (2013.01)

(58) Field of Classification Search
CPC .... B61D 19/004; B61D 19/02; B61D 19/023; B61D 23/00; B61D 23/02; Y02T 30/00
See application file for complete search history.

(56) References Cited

U.S. PATENT DOCUMENTS 4,216,725 A * 8/1980 Hallam ..... B61D 17/20 49/141
11,305,791 B2 * 4/2022 Ren ..... B61F 3/12
11,312,399 B2 * 4/2022 Ren ..... B61F 3/16
11,639,187 B2 * 5/2023 Zhao ..... B61F 9/00 104/118
2019/0283783 A1 * 9/2019 Ren ..... B61D 17/10
(Continued)

FOREIGN PATENT DOCUMENTS

CN 201265309 Y * 7/2009
CN 202866511 U * 4/2013
(Continued)

OTHER PUBLICATIONS

International Search Report and Written Opinion for Application No. PCT/CN2022/126476, mailed on Jan. 16, 2023, 8 pages.

*Primary Examiner* — Jason C Smith
(74) *Attorney, Agent, or Firm* — Sheppard Mullin Richter & Hampton LLP

(57) ABSTRACT

A rail vehicle, includes: a vehicle body including an escape exit; an escape door being openable and configured to close the escape exit; an escape ladder disposed at the escape exit, and configured to be folded at a folded position on an inside of the escape door, and to extend out of the vehicle body at an unfolding position to form a passage from the vehicle body to an escape passage; and a cover plate assembly being openable to cover the inside of the escape door, and the escape ladder configured to be folded at the folded position between the cover plate assembly and the escape door and covered by the cover plate assembly.

21 Claims, 14 Drawing Sheets

(56) References Cited

U.S. PATENT DOCUMENTS

| | | | | |
|---|---|---|---|---|
| 2020/0017126 | A1* | 1/2020 | Ren | B61D 19/023 |
| 2024/0227876 | A1* | 7/2024 | Guan | B61D 19/004 |

FOREIGN PATENT DOCUMENTS

| | | | | | |
|---|---|---|---|---|---|
| CN | 205905984 | U | | 1/2017 | |
| CN | 106985840 | A | | 7/2017 | |
| CN | 106985847 | A | | 7/2017 | |
| CN | 106994980 | B | * | 11/2019 | B61C 9/50 |
| CN | 111098872 | A | * | 5/2020 | B61D 23/02 |
| CN | 210733982 | U | * | 6/2020 | |
| CN | 210793175 | U | * | 6/2020 | |
| CN | 216508340 | U | | 5/2022 | |
| CN | 217705804 | U | * | 11/2022 | |
| KR | 20110107042 | A | | 9/2011 | |
| KR | 101242145 | B1 | * | 3/2013 | E05B 65/10 |

* cited by examiner

RAIL VEHICLE

CROSS-REFERENCE TO RELATED APPLICATIONS

The application is a continuation application of International Patent Application No. PCT/CN2022/126476 filed on Oct. 20, 2022, which is based on and claims priority to and benefits of Chinese Patent Application No. 202111348365.X, filed on Nov. 15, 2021. The entire content of all of the above-referenced applications is incorporated herein by reference.

FIELD

The present disclosure relates to the technical field of transportation, and particularly to a rail vehicle.

BACKGROUND

In related art, when an emergency stop occurs while a rail vehicle is traveling and the rail vehicle is located high above the ground, an escape ladder needs to be lowered at an escape door after the escape door is opened, so that passengers can escape from the vehicle to the ground in time through the escape ladder. In related art, the escape ladder is large in size and complex in structure, occupies a large space when placed in the rail vehicle, and affects the view in the vehicle. Because of the lack of a cover plate to conceal the escape ladder, the escape ladder is exposed after withdrawn, which looks cumbersome in the interior of the vehicle and is not aesthetically pleasing.

SUMMARY

The present disclosure is to provide a rail vehicle having a cover plate assembly to shield an escape ladder.

A rail vehicle according to an embodiment of the present disclosure includes: a vehicle body including an escape exit; an escape door being openable and configured to close the escape exit; an escape ladder disposed at the escape exit, and configured to be folded at a folded position on an inside of the escape door, and to extend out of the vehicle body at an unfolding position to form a passage from the vehicle body to an escape passage; and a cover plate assembly being openable to cover the inside of the escape door, and the escape ladder configured to be folded at the folded position between the cover plate assembly and the escape door and covered by the cover plate assembly.

The rail vehicle according to the embodiment of the present disclosure has the cover plate assembly to shield the escape ladder.

Additionally, the rail vehicle according to the foregoing embodiment of the present disclosure may further have the following additional technical characteristics:

In an embodiment, the cover plate assembly includes a left flipping plate and a right flipping plate, the left flipping plate is rotatably connected to a left side of the escape exit and configured to be flipped left to open the escape exit, the right flipping plate is rotatably connected to a right side of the escape exit and configured to be flipped right to open the escape exit, and the left flipping plate and the right flipping plate are configured to be shut to cover the inside of the escape door.

In an embodiment, the left flipping plate and the right flipping plate are both configured to be flipped toward an outside of the vehicle body to open the escape exit.

In an embodiment, the left flipping plate and the right flipping plate are limited by a limiting structure at a shut position to limit the left flipping plate and the right flipping plate from turning into the vehicle body.

In an embodiment, the vehicle body includes a cover opening mechanism, and the cover opening mechanism is connected to the left flipping plate and the right flipping plate and is configured to drive the left flipping plate and the right flipping plate to open.

In an embodiment, the escape ladder supports the left flipping plate and the right flipping plate at the folded position to maintain the left flipping plate and the right flipping plate in a shut state.

In an embodiment, the cover opening mechanism includes multiple springs, a first portion of the springs has two ends that are connected to the vehicle body and the left flipping plate respectively, and a second portion of the springs has two ends that are connected to the vehicle body and the right flipping plate respectively, and the springs are configured to drive the left flipping plate and the right flipping plate to open.

In an embodiment, a first flexible limiting block is disposed between the escape ladder and the left flipping plate, and a second flexible limiting block is disposed between the escape ladder and the right flipping plate when the escape ladder is at the folded position.

In an embodiment, the left flipping plate and the right flipping plate at least partially overlap when shut.

In an embodiment, an upper end of the escape door is hinged to an upper side of the escape exit, the escape door is configured to be flipped up to open the escape exit, and the cover plate assembly further includes an upflipping plate fixedly connected to the escape door, and configured to cover an upper portion of the escape ladder and to flip up along with the escape door.

In an embodiment, an end of the upflipping plate extends down and is configured to hook onto an upper end of the escape ladder.

In an embodiment, the upflipping plate, the left flipping plate, and the right flipping plate have smooth transition surfaces when covering the escape ladder.

In an embodiment, the upper end of the escape door is hinged to the upper side of the escape exit, and the escape door is configured to be flipped up to open the escape exit.

In an embodiment, the escape door includes a first magnetic member, the escape ladder includes a pull rope, the pull rope includes a second magnetic member configured to attract the first magnetic member, and the escape door is configured to drive the escape ladder to flip outwards through the pull rope when the escape door opens.

In an embodiment, the rail vehicle further includes a first support rod, a second support rod, and a positioning mechanism. The first support rod is connected to the escape ladder; the second support rod is connected to the vehicle body; the positioning mechanism is connected to the escape ladder, the first support rod, the second support rod, and the vehicle body. When the escape ladder is folded, the first support rod is folded on the escape ladder, and the second support rod is folded on the vehicle body; and when the escape ladder is unfolded, the first support rod stands on the escape ladder, and the second support rod stands on the vehicle body.

In an embodiment, the positioning mechanism includes a first connecting rope, a second connecting rope, and a third connecting rope, the first connecting rope is connected to the escape ladder and the first support rod, the second connecting rope is connected to the first support rod and the second support rod, and the third connecting rope is connected to the second support rod and the vehicle body.

DETAILED DESCRIPTION

Figure 1:
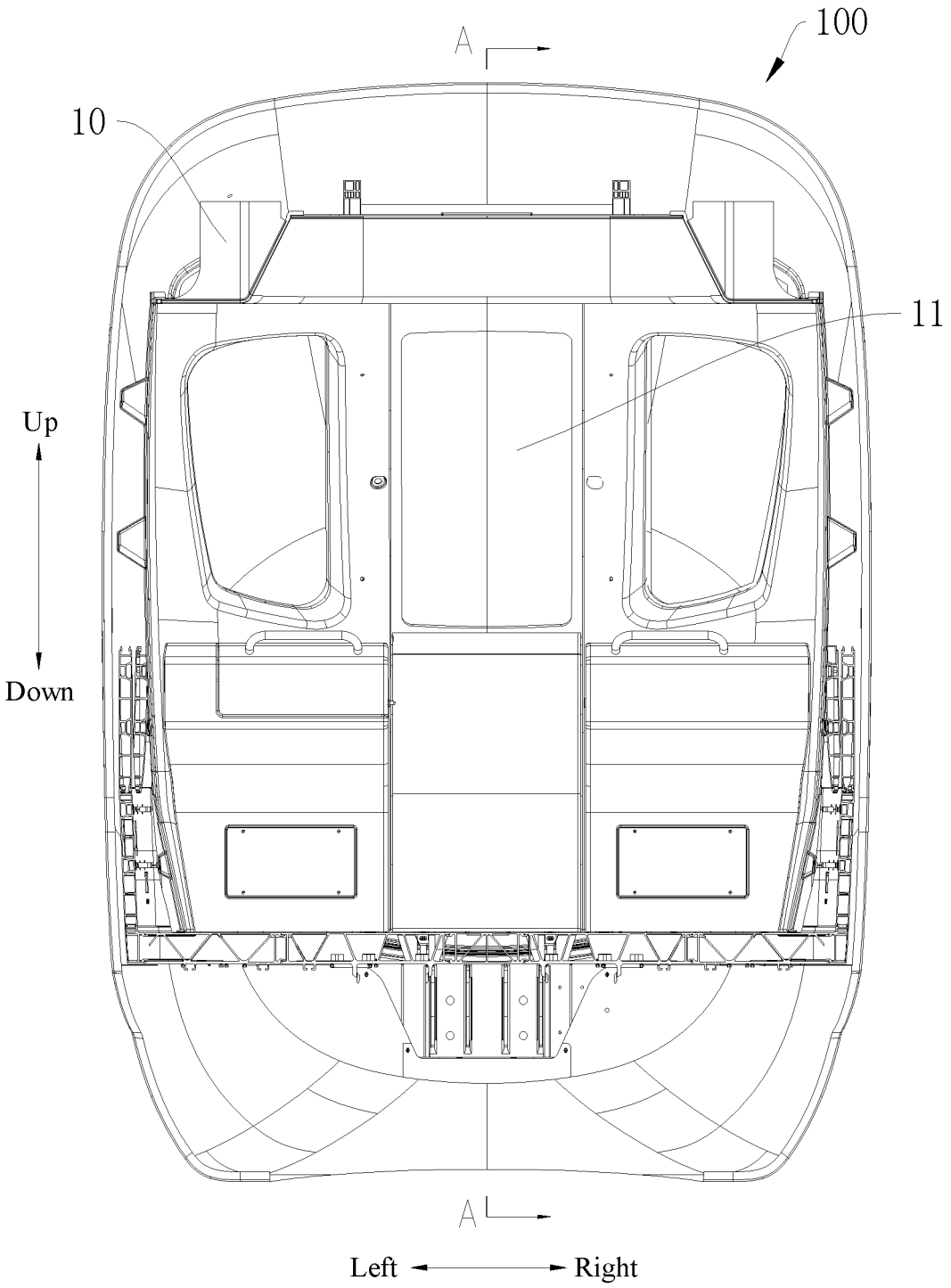
FIG. 1 is a schematic diagram of a rail vehicle of an embodiment of the present disclosure.

Embodiments of the present disclosure are described in detail below, and examples of the embodiments are shown in accompanying drawings, where the same or similar elements or the elements having same or similar functions are denoted by the same or similar reference numerals throughout the description. The embodiments described below with reference to the accompanying drawings are examples, and are to explain the present disclosure and cannot be construed as a limitation to the present disclosure.

In conjunction with FIG. 1 to FIG. 7, a rail vehicle 100 according to an embodiment of the present disclosure includes: a vehicle body 10, an escape door 11, an escape ladder 21, and a cover plate assembly 22. The vehicle body 10 is provided with an escape exit 101. The escape door 11 is openable and configured to close the escape exit 101. The escape ladder 21 is reversibly arranged/disposed at the escape exit 101. The escape ladder 21 is folded at a folded position on an inside of the escape door 11, and the escape ladder 21 extends out of the vehicle body 10 at an unfolding position and is configured to construct a passage from the vehicle body 10 to an escape passage. The cover plate assembly 22 is openable and configured to cover the inside of the escape door 11. The escape ladder 21 is folded at the folded position between the cover plate assembly 22 and the escape door 11 and covered by the cover plate assembly 22.

The rail vehicle 100 according to an embodiment of the present disclosure has the cover plate assembly 22 to shield the escape ladder 21, so that when the escape ladder 21 is not required to be used, the escape ladder 21 may be folded in the vehicle body 10 and shielded by using the cover plate assembly 22, so as to reduce the possibility of dust and the like entering the escape ladder 21, avoiding damage to the escape ladder 21 and preventing an escape apparatus 20 from being unavailable for use, and an exposed structure of the escape apparatus 20 is relatively simple due to shielding of the cover plate assembly 22, facilitating cleanup of the vehicle having the escape apparatus 20.

The cover plate assembly 22 may have multiple different forms. For example, the cover plate assembly 22 is arranged/disposed as a sliding opening door, etc. The present disclosure provides some embodiments of the cover plate assembly 22.

As in FIG. 4 to FIG. 7, in some embodiments of the present disclosure, the cover plate assembly 22 is divided into multiple portions, and at least one portion adopts a turn-open mode, such that the at least one portion may be open by turning the portion of the cover plate assembly 22. In an embodiment, the cover plate assembly 22 includes a left flipping plate 221 and a right flipping plate 222. The left flipping plate 221 is rotatably connected to a left side of the escape exit 101 and configured to be flipped left to open the escape exit 101. The right flipping plate 222 is rotatably connected to a right side of the escape exit 101 and configured to be flipped right to open the escape exit 101. The left flipping plate 221 and the right flipping plate 222 are configured to be mutually shut to cover the inside of the escape door 11. The left flipping plate 221 and the right flipping plate 222 may be arranged in a form similar to double doors. By arranging/configuring the left flipping plate 221 and the right flipping plate 222, space occupied by the cover plate assembly 22 when it is opened may be saved, and the left and right cover plates may provide protection for passing of people.

The left flipping plate 221 and the right flipping plate 222 of the present disclosure may be arranged/configured as: both are flipped toward an outside of the vehicle body 10 to open the escape exit 101; or one is flipped toward an inside of the vehicle body 10 to open the escape exit 101, and the other is flipped toward the outside of the vehicle body 10 to open the escape exit 101; or both are flipped toward the inside of the vehicle body 10 to open the escape exit 101. As in FIG. 5, in an example of the present disclosure, the left flipping plate 221 and the right flipping plate 222 are both configured to be flipped toward the outside of the vehicle body 10 to open the escape exit 101. The left flipping plate 221 and the right flipping plate 222 may be avoided from occupying space inside the vehicle body 10, while obstacles to movements of people inside the vehicle body 10 may be avoided, and it may also be convenient for people to pass through the escape exit 101.

The left flipping plate 221 and right flipping plate 222 are limited by a limiting structure at a mutually shut position to limit turning of the left flipping plate 221 and the right flipping plate 222 into the vehicle body 10. In other words, the vehicle body 10 is provided with the limiting structure, and the limiting structure provides a limitation on turning of the left flipping plate 221 and the right flipping plate 222. That is, the left flipping plate 221 and the right flipping plate 222 are flipped between a position at which they are mutually shut and a position at which they are flipped and unfolded mutually toward the outside of the vehicle body 10, and when the left flipping plate 221 and the right flipping plate 222 are flipped toward the inside of the vehicle body 10, the left flipping plate 221 and the right flipping plate 222 have a limit position at which the left flipping plate 221 and the right flipping plate 222 are mutually shut.

The left flipping plate 221 and the right flipping plate 222 are each connected to the vehicle body 10 through a hinging member, where the hinging member may be a hinging structure such as a hinge, and the limiting structure may be arranged on the hinging member.

Figure 6:
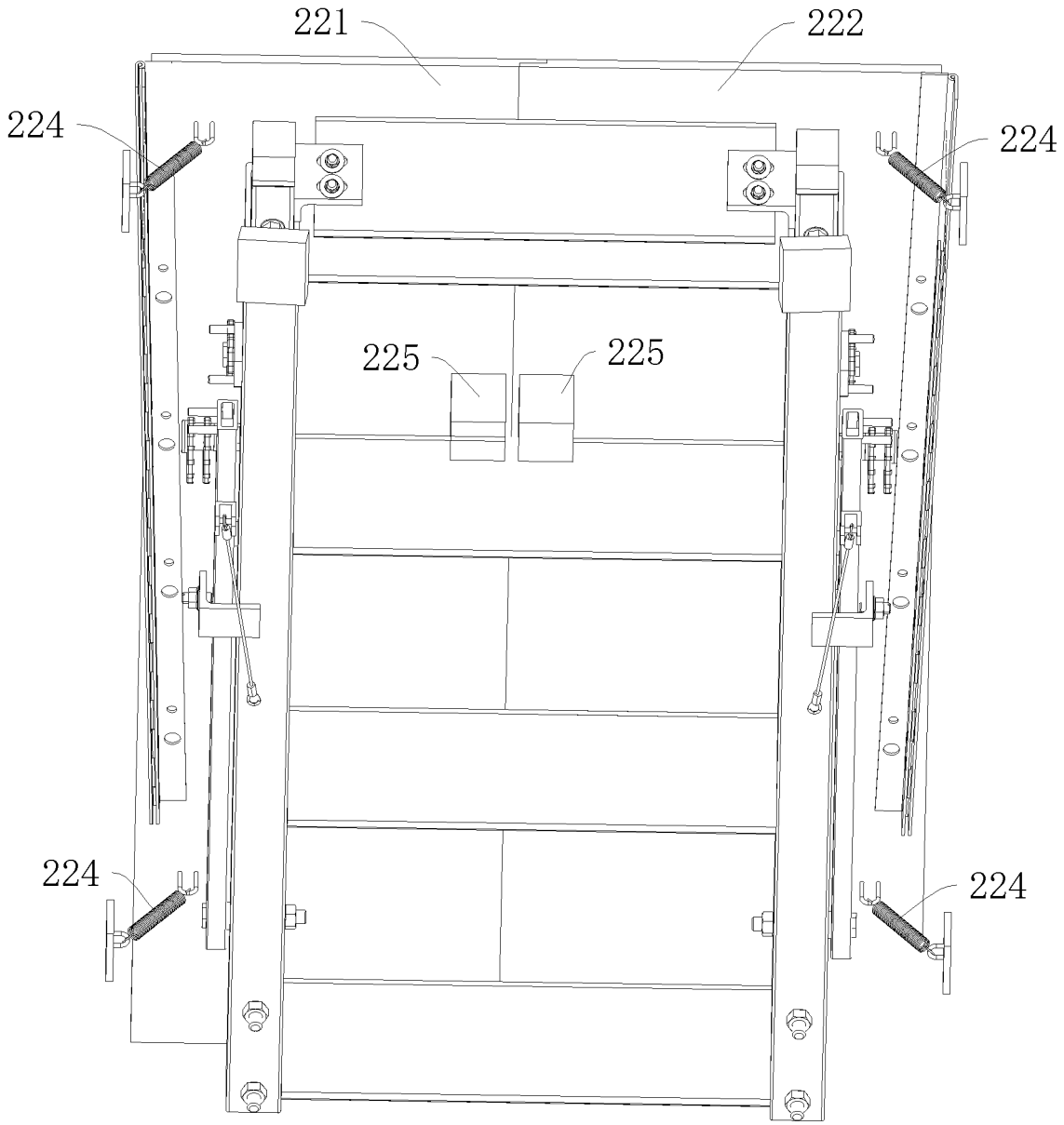
FIG. 6 is a partial schematic diagram of a rail vehicle of an embodiment of the present disclosure.

The left flipping plate 221 and the right flipping plate 222 in the present disclosure may be arranged to be driven open and closed by utilizing a cover opening mechanism. As shown in FIG. 6, the vehicle body 10 is in the present disclosure is provided with the cover opening mechanism. The cover opening mechanism is connected to the left flipping plate 221 and the right flipping plate 222 and is configured to drive the left flipping plate 221 and the right flipping plate 222 to open. By arranging/configuring the cover opening mechanism, it is possible to facilitate opening of the left flipping plate 221 and the right flipping plate 222 so as to improve the automation of an escape structure and facilitate an operation.

The cover opening mechanism may be a structure such as a pneumatic rod, a hydraulic rod, a motor, etc., and opening and closing of the left flipping plate 221 and the right flipping plate 222 may be implemented by the cover opening mechanism. In addition, the present disclosure provides a mode of utilizing an elastic structure to implement opening of the left flipping plate 221 and the right flipping plate 222.

As in FIG. 6, the left flipping plate 221 and the right flipping plate 222 may be arranged/configured to be opened and closed along with other components. For example, the left flipping plate 221 and the right flipping plate 222 are arranged to be opened along with the escape door 11; or the left flipping plate 221 and the right flipping plate 222 are arranged to be opened along with the escape ladder 21. As shown in FIG. 6, a solution in which the left flipping plate 221 and the right flipping plate 222 are opened along with the escape ladder 21 is provided in the present disclosure. In an embodiment, the escape ladder 21 supports the left flipping plate 221 and the right flipping plate 222 at the folded position to maintain the left flipping plate 221 and the right flipping plate 222 in a mutually shut state. Through a combination of the cover opening mechanism and the escape ladder 21, when the escape ladder 21 is folded in the vehicle body 10, the escape ladder 21 can support the left flipping plate 221 and the right flipping plate 222 to maintain the left flipping plate 221 and the right flipping plate 222 at a position of covering the escape ladder 21. When the escape ladder 21 is flipped to extend out of the vehicle body 10, the left flipping plate 221 and the right flipping plate 222 will lose support of the escape ladder 21, and thus the cover is opened under the action of the cover opening mechanism.

As shown in FIG. 6, the cover opening mechanism includes multiple springs 224, two ends of a portion (e.g., a first portion) of the multiple springs 224 are connected to the vehicle body 10 and the left flipping plate 221 respectively, and two ends of another portion (e.g., a second portion) of the multiple springs 224 are connected to the vehicle body 10 and the right flipping plate 222 respectively, and the springs 224 often have a force to drive the left flipping plate 221 and the right flipping plate 222 to open. Through the elastic force of the multiple springs 224, it is possible to make the left flipping plate 221 and the right flipping plate 222 always have a force for opening the cover. For example, when the left flipping plate 221 and the right flipping plate 222 are not supported by the escape ladder 21 and the like, the elastic force of the springs 224 will drive the left flipping plate 221 and the right flipping plate 222 to open. Thus, linking the escape ladder 21 with the left flipping plate 221 and the right flipping plate 222 enables quick opening of the left flipping plate 221 and the right flipping plate 222 when the escape ladder 21 is unfolded, and to quickly construct a passage for passing. After unfolding the escape ladder 21, it is no longer necessary to keep the left flipping plate 221 and the right flipping plate 222 open, which is simple to operate.

The springs 224 are connected to both left and right sides of the escape exit of the vehicle body 10, where the springs 224 which are connected to a wall panel at a left end of the escape exit are connected to the left flipping plate 221 and have a force to drive the left flipping plate 221 to open. The springs 224 which are connected to a wall panel at a right end of the escape exit are connected to the right flipping plate 222 and have a force to drive the right flipping plate 222 to open. The springs connected to the left flipping plate 221 include two springs connected to upper and lower sides of the left flipping plate 221 respectively. The springs connected to the right flipping plate 222 include two springs connected to upper and lower sides of the right flipping plate 222 respectively.

In an embodiment, a flexible limiting block 225 is arranged/disposed between the escape ladder 21 and the left flipping plate 221, and another flexible limiting block 225 is arranged/disposed between the escape ladder 21 and the right flipping plate 222, when the escape ladder 21 is at the folded position. By arranging/configuring the flexible limiting block 225, stable support of the escape ladder 21 to the left flipping plate 221 and the right flipping plate 222 can be implemented, so that the left flipping plate 221 and the right flipping plate 222 are stably maintained in a closed state. Moreover, a problem of interference between the escape ladder 21 and the left flipping plate 221 as well as the right flipping plate 222 due to production, assembly precision and other factors is avoided. In addition, in conjunction with the above description, the left flipping plate 221 and the right flipping plate 222 are limited by the limiting structure at the mutually shut position, and the left flipping plate 221 and the right flipping plate 222 cannot continue to be flipped toward the inside of the vehicle body 10. Thus, by the combination of the flexible limiting block 225 and the limiting structure, it is possible to enable the left flipping plate 221 and the right flipping plate 222 to be stably maintained in the closed state.

The flexible limiting block 225 may be a rubber limiting block, etc.

Figure 7:
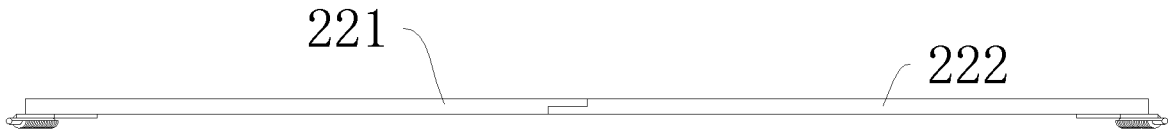
FIG. 7 is a schematic diagram of matching of a left flipping plate and a right flipping plate of a rail vehicle of an embodiment of the present disclosure.

As in FIG. 7, in some embodiments of the present disclosure, the left flipping plate 221 and the right flipping plate 222 at least partially overlap when mutually shut. Therefore, it may be convenient to implement stable covering of the escape ladder 21 through the left flipping plate 221 and the right flipping plate 222, to improve the stability of the escape ladder 21, to avoid a problem that the escape ladder 21 cannot be used when needed, and to effectively improve the stable operation and safety of the rail vehicle 100.

In an embodiment of the present disclosure, an end edge of the left flipping plate 221 has a first notch, an end edge of the right flipping plate 222 has a second notch, and the end edge of the left flipping plate 221 and the end edge of the right flipping plate 222 are embedded or connected to each other when the left flipping plate 221 and the right flipping plate 222 are shut.

Figure 5:
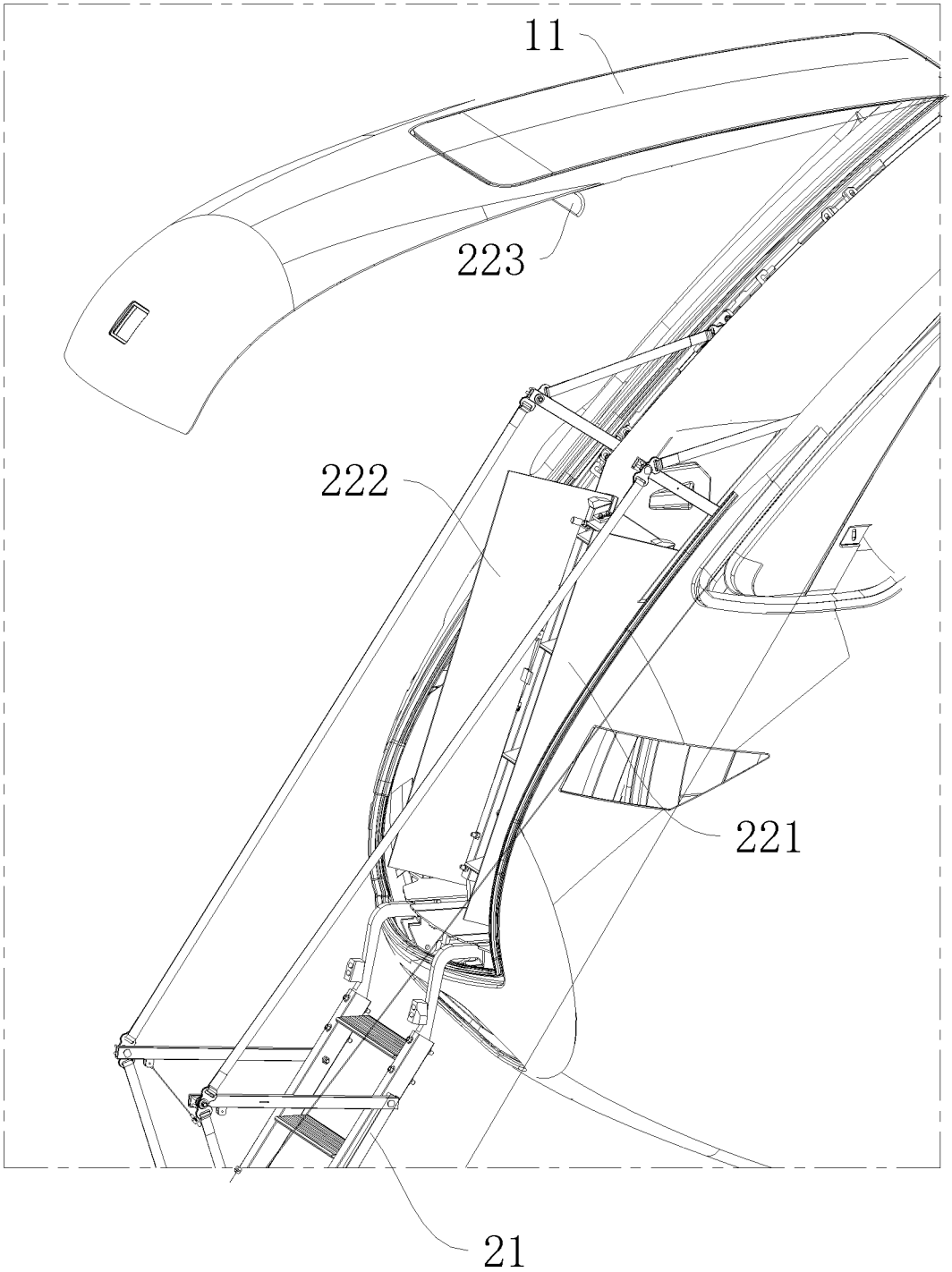
FIG. 5 is a partial schematic diagram of a rail vehicle of an embodiment of the present disclosure, where an escape apparatus is fully unfolded.

As in FIG. 5, in some examples of the present disclosure, an upper end of the escape door 11 is hinged to an upper side of the escape exit 101, the escape door 11 is configured to be flipped up to open the escape exit 101, the cover plate assembly 22 further includes an upflipping plate 223, and stable covering of an upper side of the escape ladder 21 can be implemented by arranging the upflipping plate 223, so as to enable the construction of relatively closed space between the cover plate assembly 22 and the escape door 11 for folding of the escape ladder 21. At the same time, by dividing the cover plate assembly 22 into the upflipping plate 223, the left flipping plate 221, and the right flipping plate 222, it is possible to facilitate the independent movement of each cover plate. Shapes of the cover plates are simplified by completely covering of the escape ladder 21, to avoid a problem that the cover plates interfere with other components during opening and the cover plates are not easy to open.

The upflipping plate 223 is fixedly connected to the escape door 11 and configured to cover an upper portion of the escape ladder 21, and the upflipping plate 223 is configured to be flipped up along with the escape door 11, so as to make the linkage between the upflipping plate 223 and the escape door 11 to completely open the upflipping plate 223 when the escape door 11 is opened, to simplify operation steps, and to improve the stability of the escape ladder 21 when is used.

In the present disclosure, the linkage between the escape door 11 and the escape ladder 21 may be utilized to achieve unfolding of the escape ladder 21 driven by opening of the escape door 11, for example, an end of the upflipping plate 223 may extend down and be configured to hook onto an upper end of the escape ladder 21. Therefore, driving the escape ladder 21 can be implemented through the upflipping plate 223, or in other words, the linkage between the escape door 11 and the escape ladder 21 can be implemented, which further facilitates unfolding of the escape ladder 21.

The upflipping plate 223, the left flipping plate 221, and the right flipping plate 222 have smooth transition surfaces when covering the escape ladder 21. Optimizing an appearance of the cover plate assembly 22 may prevent the cover plate assembly 22 from affecting passage during normal travel of the rail vehicle 100, and may also facilitate cleaning of the interior of the rail vehicle 100.

In an embodiment, an upper end of the escape door 11 is hinged to an upper side of the escape exit 101, and the escape door 11 is configured to be flipped up to open the escape exit 101. The escape door 11 is provided with a first magnetic member 293. The escape ladder 21 is provided with a pull rope 291, the pull rope 291 is provided with a second magnetic member 292 configured to attract the first magnetic member 293, and when opened, the escape door 11 is configured to drive the escape ladder 21 to be flipped outwards through the pull rope 291. When the escape exit 101 needs to be used, only the escape door 11 needs to be opened. In a process of opening the escape door 11, the pull rope 291 will drive the escape ladder 21 to be flipped down to open, and when the escape ladder 21 unfolds to a certain angle, in this case, the escape ladder 21 may continue to unfold under the action of gravity and inertia. Under the action of gravity, the momentum of the escape ladder 21 is sufficient to separate the first magnetic member 293 from the second magnetic member 292. The pull rope 291 can be also separated from the escape door 11, so as to avoid the escape door 11 from influencing the continuation of unfolding of the escape ladder 21, and to implement the linkage of the escape door 11 and the escape ladder 21. Both the first magnetic member 293 and the second magnetic member 292 may be permanent magnets. Or one of the first magnetic member 293 and the second magnetic member 292 is a permanent magnet, and the other is a magnetic conductor (e.g., an iron block, etc.). In addition, at least one of the first magnetic member 293 and the second magnetic member 292 may also be arranged/configured as an electromagnet, etc.

In addition, as shown in FIG. 10 to FIG. 14, transmission mechanisms may further be arranged to implement the linkage between the escape door 11 and the escape ladder 21 in the present disclosure. For example, each transmission mechanism includes a driving wheel 281, a transmission member 282, a driven wheel 285 and a synchronization belt 286, the driving wheel 281 is connected to the escape door 11, the transmission member 282 is connected to the vehicle body 10, and the driven wheel 285 is connected to the escape ladder 21 and is in a transmission connection with the transmission member 282. The synchronization belt 286 is connected to the driving wheel 281 and the transmission member 282. The driving wheel 281 may rotate along with the escape door 11. When the driving wheel 281 rotates, it will transfer the movement to the transmission member 282 via the synchronization belt 286, and the transmission member 282 will drive the driven wheel 285 to rotate, which will then drive the escape ladder 21 to be flipped down. Therefore, stable transmission between the escape door 11 and the escape ladder 21 can be implemented by the transmission mechanisms, which facilitates the power transfer of the escape door 11 and the escape ladder 21. As mentioned above, the escape door 11 will be flipped up to open the escape exit 101, the escape ladder 21 will turn down to unfold, and a certain distance may exist between a rotation shaft of the escape door 11 and a rotation shaft of the escape ladder 21. Therefore, the synchronization belt 286 is utilized in the present disclosure to implement the transmission between the driving wheel 281 and the transmission member 282.

In addition, the synchronization belt 286 is adopted and needs to span a large distance to connect the driving wheel 281 and the transmission member 282, therefore, in the present disclosure, the support wheels 287 are also arranged/configured to provide support for the synchronization belt 286 to improve the stability of the transmission of the synchronization belt 286. In an embodiment, the transmission mechanisms further include the support wheels 287, which are arranged/disposed on the vehicle body 10 and support the synchronization belt 286. Through the support of the support wheels 287, the stability of the synchronization belt 286 during the transmission can be improved, facilitating the stable transmission between the driving wheel 281 and the transmission member 282. Additionally, the support wheels 287 may further provide a tensioning effect to implement the stable match between the synchronization belt 286 and the driving wheel 281, as well as between the synchronization belt 286 and the transmission member 282. Moreover, through the support of the support wheels 287, the assignment of the synchronization belt 286 can be realized so that the synchronization belt 286 can extend along a predetermined trajectory so as to avoid problems such as interferences between the synchronization belt 286 and other components. The multiple support wheels 287 in the present disclosure may constrain the synchronization belt 286 to extend along the escape exit 101, thereby reducing the space occupied by the transmission mechanisms, and avoiding the problems such as jamming of the synchronization belt 286. The multiple support wheels 287 are arranged at the escape exit 101 of the vehicle body 10 at intervals along an up-down direction, and the multiple support wheels 287 construct the synchronization belt 286 to extend along the escape exit 101 in the up-down direction. Thus, a space utilization rate of the transmission mechanisms may be improved. When the escape exit 101 extends in an arc shape in the up-down direction, by assigning the synchronization belt 286, the synchronization belt 286 can be avoided from occupying excessive space within the vehicle body 10 compared with the synchronization belt 286 extending in a straight line direction, and the space utilization rate of the transmission mechanisms can be effectively improved. In addition, both branches of the synchronization belt 286 of the present disclosure are provided with the support wheels 287 for support, where the support wheels 287 preferably support an inside of a turn of the synchronization belt 286, and certainly other forms of arrangement are also possible for other purposes. By way of example, the support wheels 287 are arranged on lower sides of both branches of the synchronization belt 286. In addition, according to different forms of the synchronization belt 286, the support wheels 287 of corresponding structures and shapes may be arranged.

As mentioned above, a power transfer between the transmission member 282 and the driving wheel 281 in the present disclosure is carried out by using belt transmission, chain transmission, and other modes. The transmission member 282 and the driven wheel 285 in the present disclosure may adopt gear transmission and other forms. According to the actual use requirements, a linkage mechanism, a belt transmission mechanism, and other modes may also be used to realize a transmission connection between the transmission member 282 and the driven wheel 285. In some embodiments of the present disclosure, a gear transmission mode is used between the transmission member 282 and the driven wheel 285, which may improve the stability of the transmission. In an embodiment, the transmission member 282 further includes a transmission wheel 284, and at least one of the transmission wheel 284 and the driven wheel 285 is a teeth-uncompleted gear, so that the transmission wheel 284 meshes with the driven wheel 285 after the escape door 11 is opened at a predetermined angle. Intermittent transmission may be realized by arranging one of the transmission wheel 284 and the driven wheel 285 as a teeth-uncompleted gear. In an embodiment, if only the transmission wheel 284 is a teeth-uncompleted gear, the transmission wheel 284 will not be able to transfer rotation of the transmission wheel 284 onto the driven wheel 285 during the transmission process if a teeth-uncompleted part on the transmission wheel 284 is matched with the driven wheel 285, so as to realize isolation of transmission between the escape door 11 and the escape ladder 21. Whereas when wheel teeth on the transmission wheel 284 are matched with the driven wheel 285, stable transmission of the transmission wheel 284 and the driven wheel 285 can be realized. The transmission wheel 284 will not be able to transfer the rotation of the transmission wheel 284 onto the driven wheel 285 during the transmission process if only the driven wheel 285 is a teeth-uncompleted gear and a teeth-uncompleted part on the driven wheel 285 is matched with the transmission wheel 284, so as to realize isolation of transmission between the escape door 11 and the escape ladder 21. Whereas when the transmission wheel 284 are matched with wheel teeth on the driven wheel 285, stable transmission of the transmission wheel 284 and the driven wheel 285 can be realized. Certainly, both the transmission wheel 284 and the driven wheel 285 in the present disclosure may also be arranged/configured as teeth-uncompleted gears. In order to facilitate opening of the escape ladder 21, in the present disclosure, the escape door 11 is not in a transmission connection with the escape ladder 21 until the escape door 11 is opened at a predetermined angle. For example, when the escape door 11 is opened, the driven wheel 285 and the transmission wheel 284 are isolated from each other (not meshing). In this case, the escape door 11 may be opened alone without driving the escape ladder 21. When the escape door 11 is opened to a predetermined angle or a predetermined position, the transmission wheel 284 meshes with the driven wheel 285, so that the power can be transferred from the escape door 11 to the escape ladder 21, thereby realizing the transmission between the escape door 11 and the escape ladder 21, and facilitating the opening of the escape ladder 21 by using the escape door 11.

Figure 12:
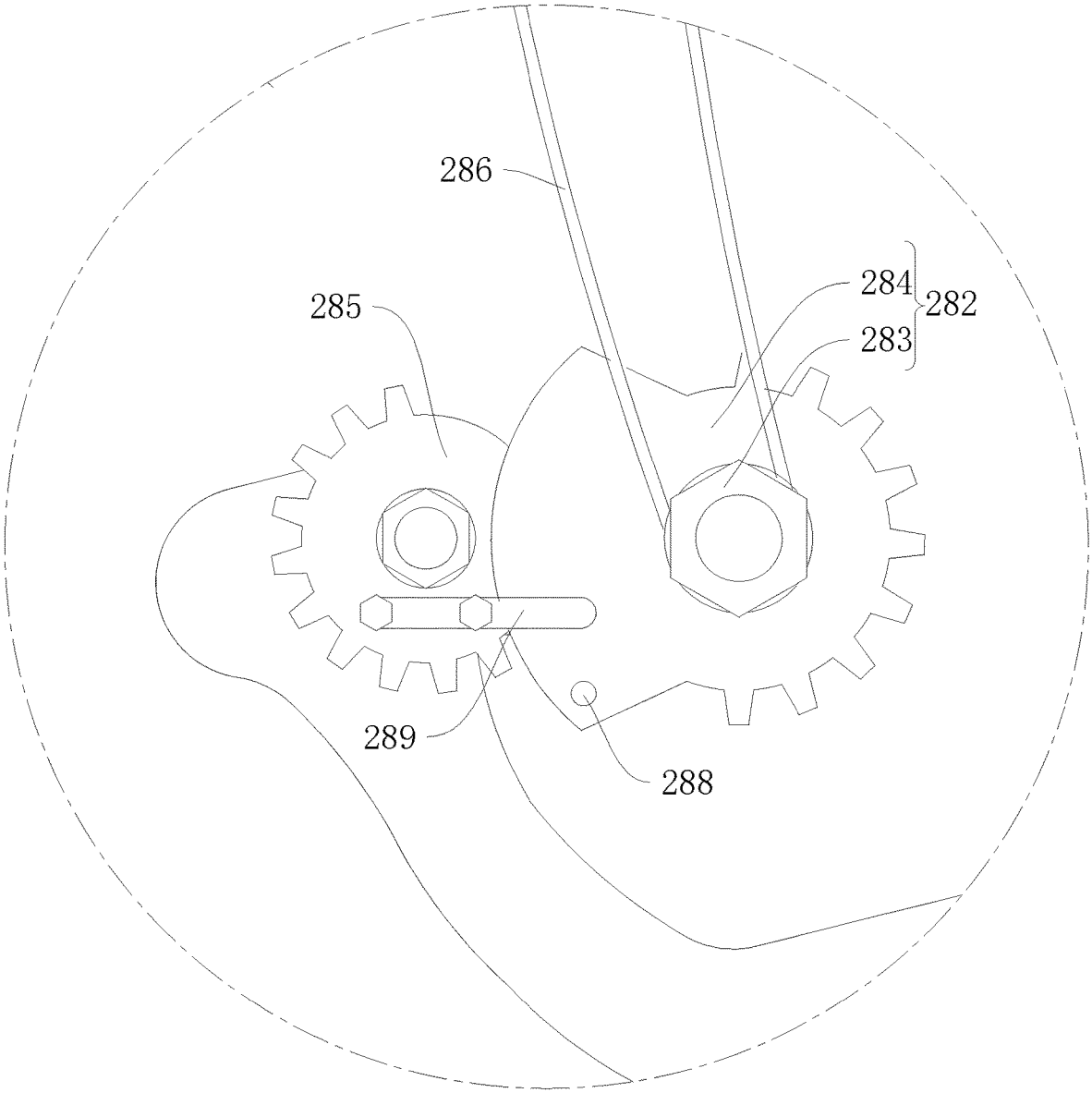
FIG. 12 is a partially enlarged schematic diagram of a region of a circle C in FIG. 10.
Figure 13:
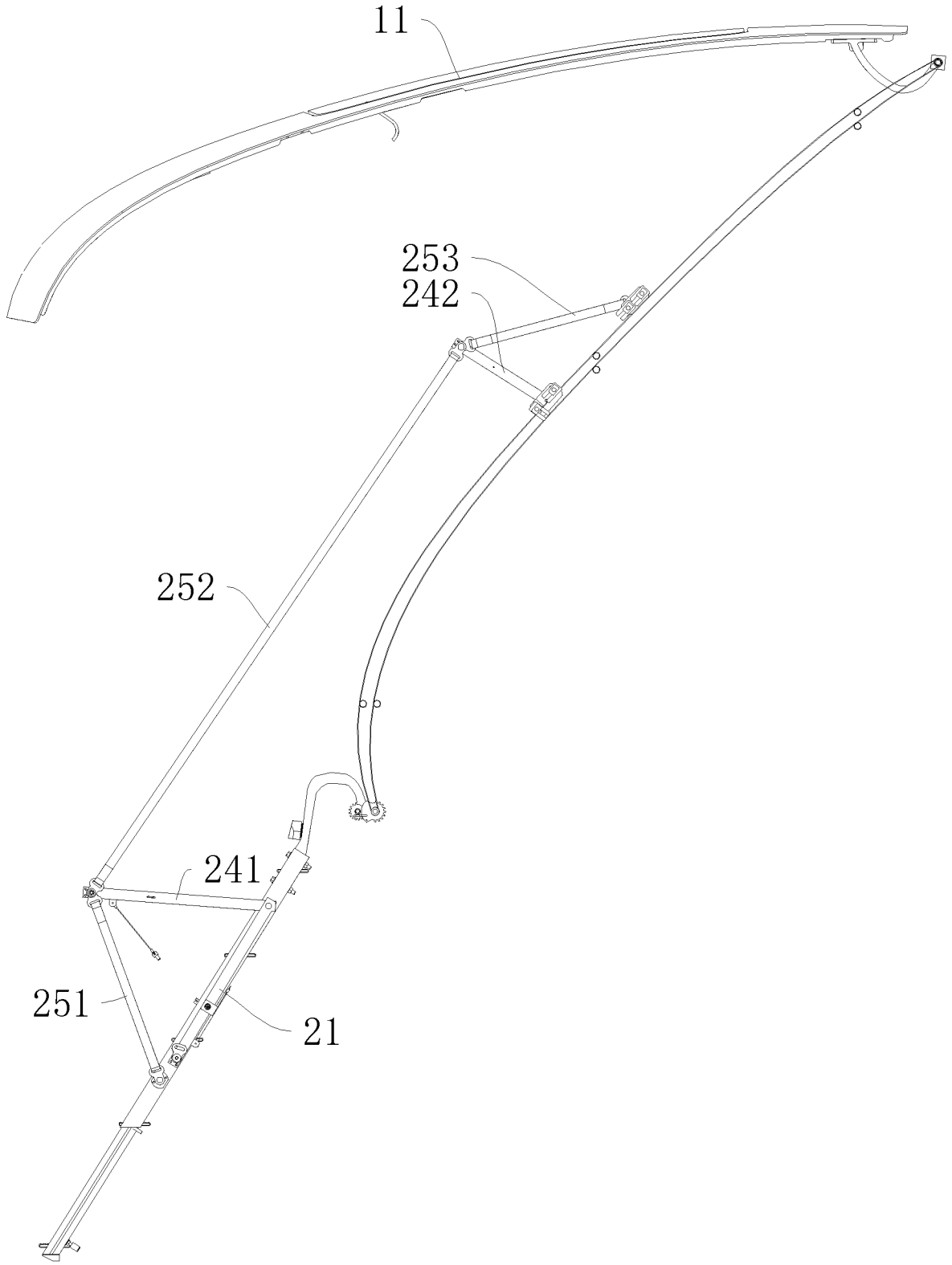
FIG. 13 is a schematic diagram of a linkage between an escape door and an escape apparatus in a rail vehicle of an embodiment of the present disclosure, where the escape apparatus is unfolded.
Figure 14:
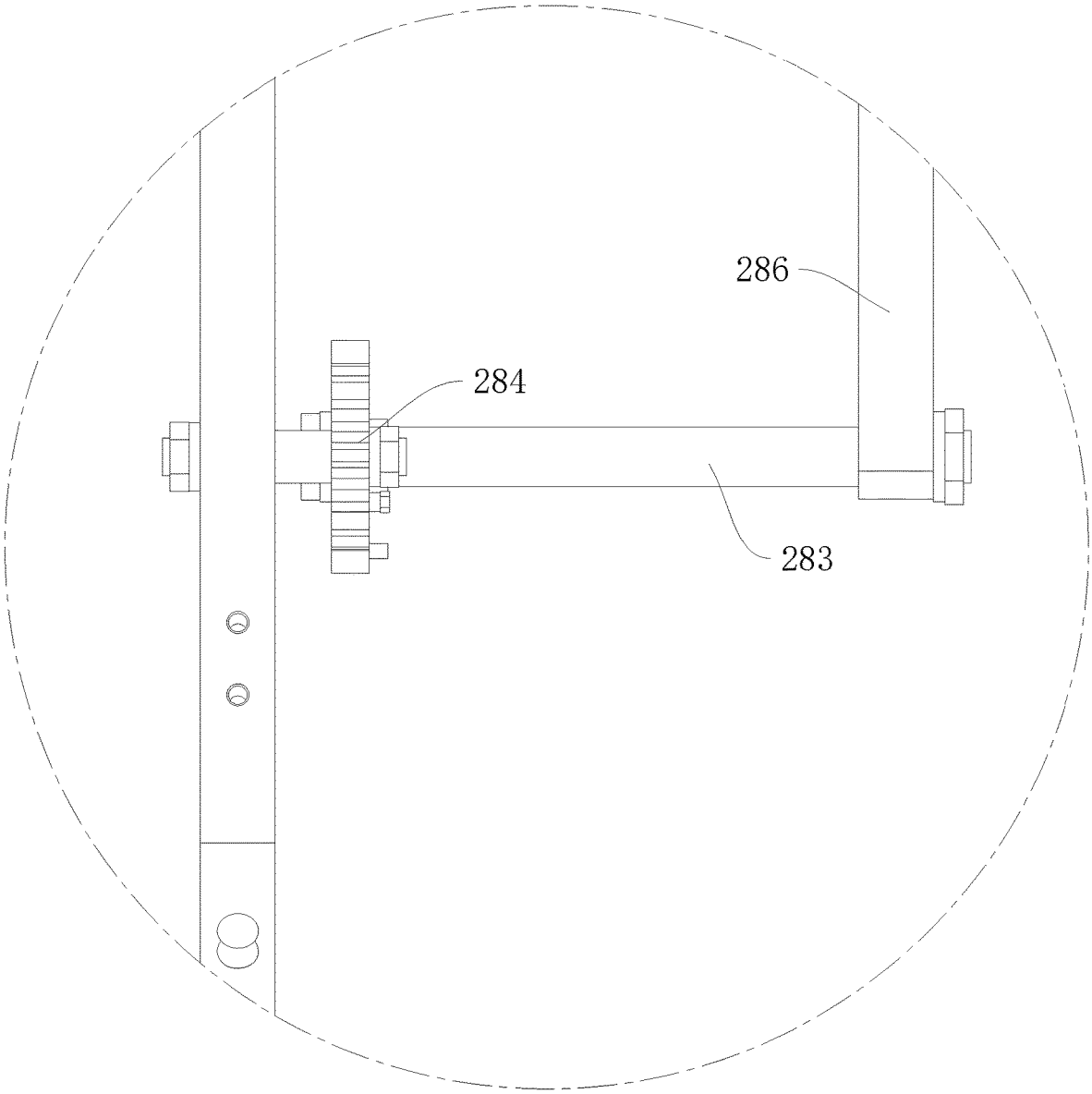
FIG. 14 is a schematic diagram of a transmission member in a rail vehicle of an embodiment of the present disclosure.
Figure 15:
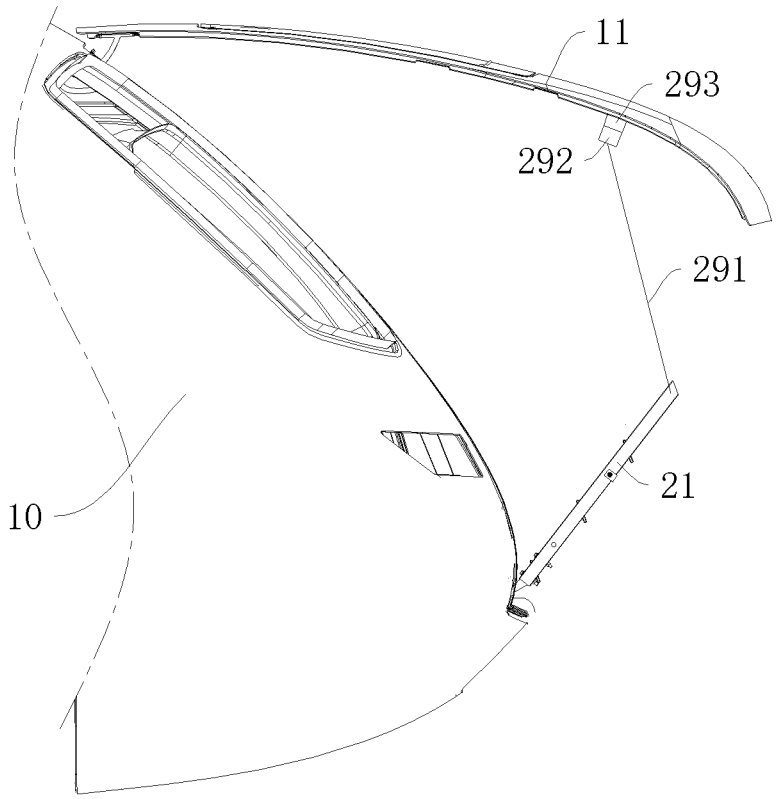
FIG. 15 is a schematic diagram of a linkage between an escape door and an escape apparatus in a rail vehicle of another embodiment of the present disclosure.

As previously mentioned, a no-meshing state and a mutual meshing state exist between the transmission wheel 284 and the driven wheel 285 in the present disclosure. After the escape door 11 is opened at a predetermined angle, the transmission wheel 284 and the driven wheel 285 mesh together. This means that the transmission wheel 284 and the driven wheel 285 need to switch between the mutual meshing state and the no-meshing state. In order to facilitate switching of the mating states between the transmission wheel 284 and the driven wheel 285, a transition structure is arranged/configured in the present disclosure. As shown in FIG. 12, the transmission wheel 284 includes a first gear segment and a first transition segment. The driven wheel 285 includes a second gear segment and a second transition segment. The transmission wheel 284 is provided with a transition rod 288. The transition rod 288 is arranged/disposed on the first transition segment. The driven wheel 285 is provided with a gear lever 289. The gear lever 289 is arranged/disposed on the second transition segment. The transition rod 288 and the gear lever 289 are matched to allow the first gear segment to mesh with the second gear segment. In an embodiment, when the escape door 11 is just opened, the first transition segment of the transmission wheel 284 is matched with the second transition segment of the driven wheel 285. Thus, the transmission wheel 284 will be separated from the driven wheel 285, and transmission cannot be conducted. After the escape door 11 is opened at a predetermined angle, the transition rod 288 is in contact with the gear lever 289, and with transmission of the transmission wheel 284, the transmission wheel 284 is gradually synchronized with the driven wheel 285, the first gear segment and the second gear segment are in a state ready for meshing (gear teeth correspond to one another), with further rotation of the transmission wheel 284, the first gear segment on the transmission wheel 284 will mesh with the second gear segment on the driven wheel 285, thus the driven wheel 285 may be driven to rotate via the transmission wheel 284, and then the escape door 11 drives the escape ladder 21 to unfold. Therefore, the stability of power transmission is improved.

The transmission mechanisms are arranged on both a left side and a right side of the escape exit 101. By arranging the transmission mechanisms on the left and right sides of the escape exit 101, the space occupation by the transmission mechanisms may be reduced, and the passage efficiency is improved. Moreover, the stable transmission of the power between the escape door 11 and the escape ladder 21 may also be improved, avoiding a problem of insufficient power or a power deviation to the left or right.

In conjunction with the previous embodiment, the cover plate assembly 22 includes an upflipping plate 223, a left flipping plate 221, and a right flipping plate 222. The upflipping plate 223 is in linkage with the escape door 11. The left flipping plate 221 and the right flipping plate 222 are in linkage with the escape ladder 21. The escape ladder 21 is in linkage with the escape door 11. In this way, when the escape exit 101 needs to be used, it is only necessary to open the escape door 11, and the escape door 11 will drive the escape ladder 21 to be flipped down to unfold. At the same time, the escape door 11 is flipped down and opened to drive the left flipping plate 221, and the right flipping plate 222 to be flipped outward and open. This realizes the linkage of the entire escape apparatus 20 and simplifies the use of the escape apparatus 20.

Figure 8:
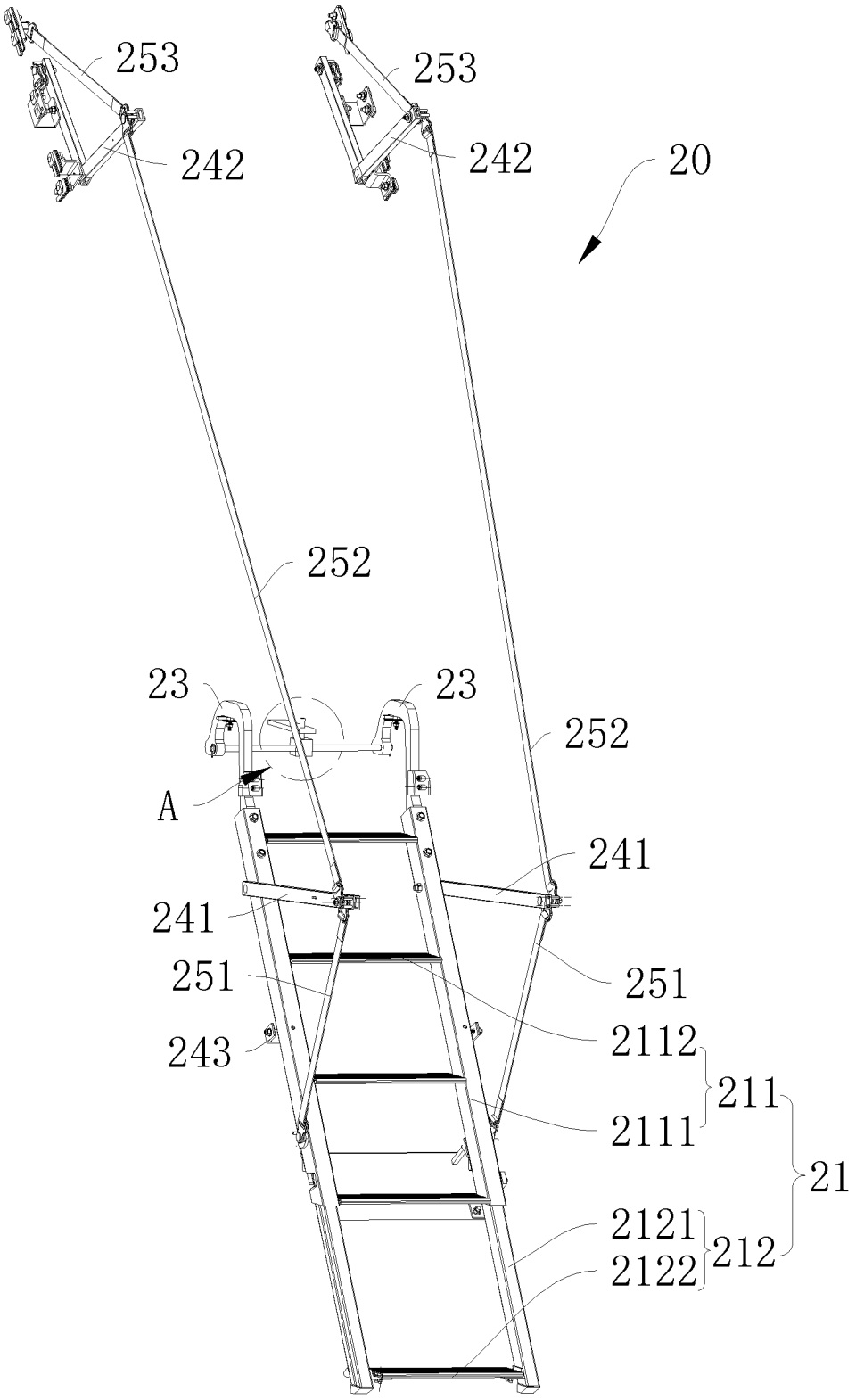
FIG. 8 is a schematic diagram of an escape ladder of an embodiment of the present disclosure.

As in FIG. 8, in some embodiments of the present disclosure, the rail vehicle 100 further includes a first support rod 241, a second support rod 242 and a positioning mechanism. The first support rod 241 is rotatably connected to the escape ladder 21. The second support rod 242 is rotatably connected to vehicle body 10. The positioning mechanism is sequentially connected to the escape ladder 21, the first support rod 241, the second support rod 242, and the vehicle body 10. When the escape ladder 21 is folded, the first support rod 241 is folded on the escape ladder 21, and the second support rod 242 is folded on the vehicle body 10. When the escape ladder 21 is unfolded, the first support rod 241 is configured to stand on the escape ladder 21, and the second support rod 242 is configured to stand on the vehicle body 10. In other words, when the escape ladder 21 is folded in the vehicle body 10, the space occupied by the escape apparatus 20 may be reduced due to the folding of the first support rod 241 and the second support rod 242. When it is required to be used, the positioning mechanism will be supported by the first support rod 241 and the second support rod 242. In this way, not only convenient to implement effective positioning of the escape ladder 21 to avoid the escape ladder 21 from being detached from a predetermined position, but also the positioning mechanism may be utilized to construct a form of a handrail to facilitate the passage.

As in FIG. 8, the positioning mechanism includes a first connecting rope 251, a second connecting rope 252, and a third connecting rope 253. The first connecting rope 251 is connected to the escape ladder 21 and the first support rod 241. The second connecting rope 252 is connected to the first support rod 241 and the second support rod 242. The third connecting rope 253 is connected to the second support rod 242 and the vehicle body 10. During folding, the third connecting rope is in a slack state because the escape ladder 21 is folded in the vehicle body 10, the first support rod 241 and the second support rod 242 are close, and the second connecting rope 252 will also be in a slack state. Similarly, the first connecting rope will also be in a slack state when there is no acting force from the second connecting rope and the third connecting rope. In this case, when there is no pulling force from the positioning mechanism, the first support rod 241 will be folded to the escape ladder 21, and the second support rod 242 will be folded to the vehicle body 10 to realize folding of the escape ladder 21, the first support rod 241, and the second support rod 242, so as to reduce the space occupation. During unfolding, the escape ladder 21 extends out of the vehicle body 10, and the third connecting rope is pulled tight. Also, the first support rod 241 and the second support rod 242 are far apart, and the second connecting rope 252 is pulled tight. Similarly, the first connecting rope also is in a state of tension under the acting force of the second connecting rope and the third connecting rope. Moreover, the first support rod 241 and the second support rod 242 are configured to stand due to the action of the first connecting rope 251, the second connecting rope 252, and the third connecting rope 253, thereby implementing unfolding of the first connecting rope 251, the second connecting rope 252, the third connecting rope 253, the first support rod 241, and the second support rod 242.

In an embodiment, as shown in FIG. 8, the escape ladder 21 further includes a positioning seat 243. The positioning seat 243 is arranged/disposed on the escape ladder 21, and the positioning seat 243 is limited to a side of the first support rod 241 away from the cover plate assembly 22 when the escape ladder 21 is at the folded position. Positioning of the first support rod 241 may be implemented by the positioning seat 243 so that the first support rod 241 may be stably maintained in a folded state, and it may be convenient for the first support rod 241 to move towards an unfolded state.

In addition, the positioning seat 243 may be arranged/disposed on a side face of the escape ladder 21. The positioning seat 243 may be arranged/configured in an L shape. A combination of the positioning seat 243 and the escape ladder 21 may be constructed as a positioning slot structure. When the escape ladder 21 is at the folded position, an opening of a positioning slot is toward the cover plate assembly 22, thereby implementing positioning of the first support rod 241. One end of the first support rod is hinged to the escape ladder 21, and another end of the first support rod is provided with a first connecting ring and a second connecting ring. One end of the second support rod is hinged to the vehicle body, and another end of the second support rod is provided with a third connecting ring and a fourth connecting ring.

Figure 2:
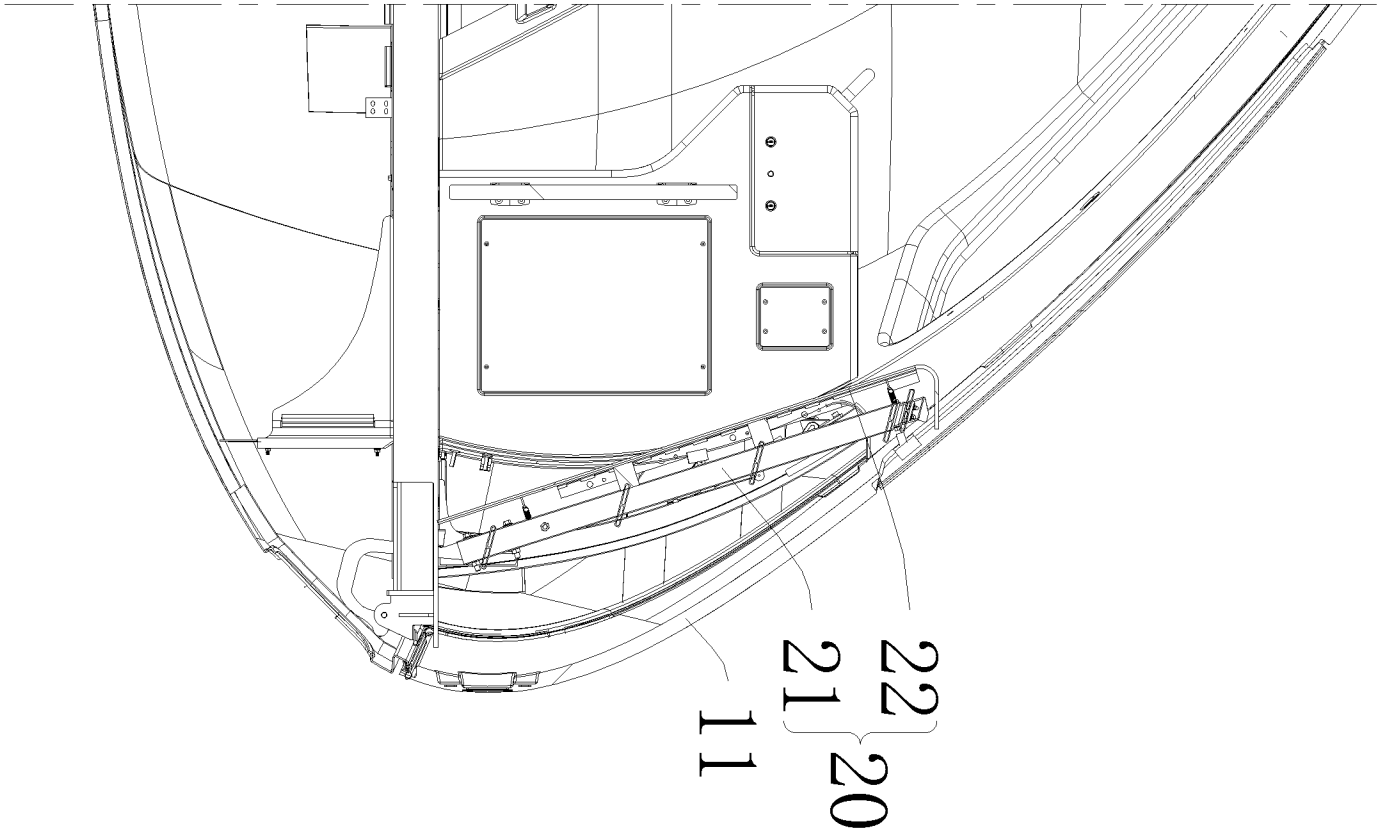
FIG. 2 is a partial schematic diagram of a rail vehicle of an embodiment of the present disclosure.
Figure 3:
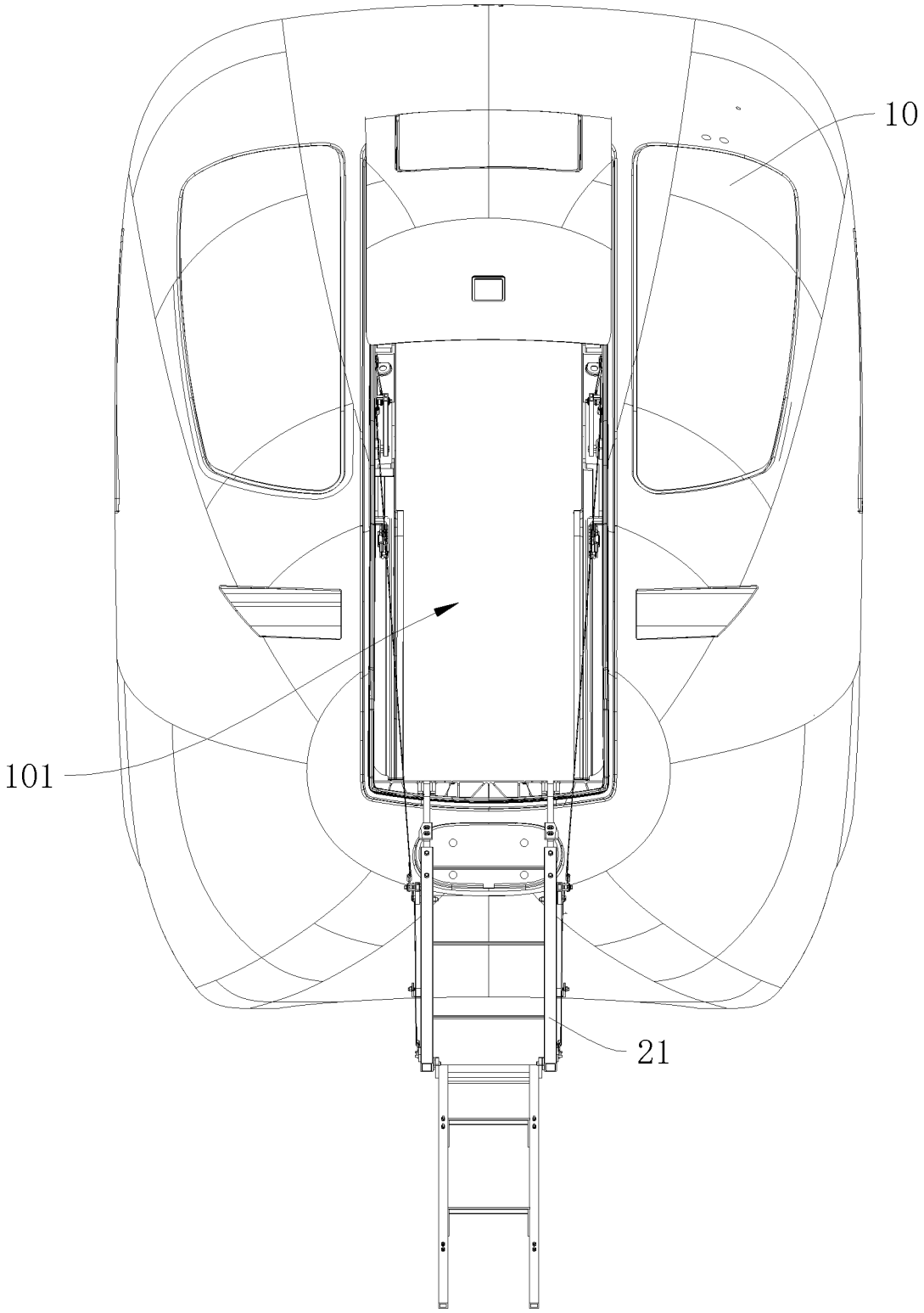
FIG. 3 is a schematic diagram of a rail vehicle of an embodiment of the present disclosure, where an escape apparatus is unfolded.

As shown in FIG. 2, the escape ladder 21 is connected to the vehicle body 10 by a hinge. The cover plate assembly 22 is arranged to conceal the escape ladder 21, resulting in an overall aesthetically pleasing and coordinated interior of the vehicle. The cover plate assembly 22 can be opened automatically without adding operation steps or increasing operation difficulty.

Figure 4:
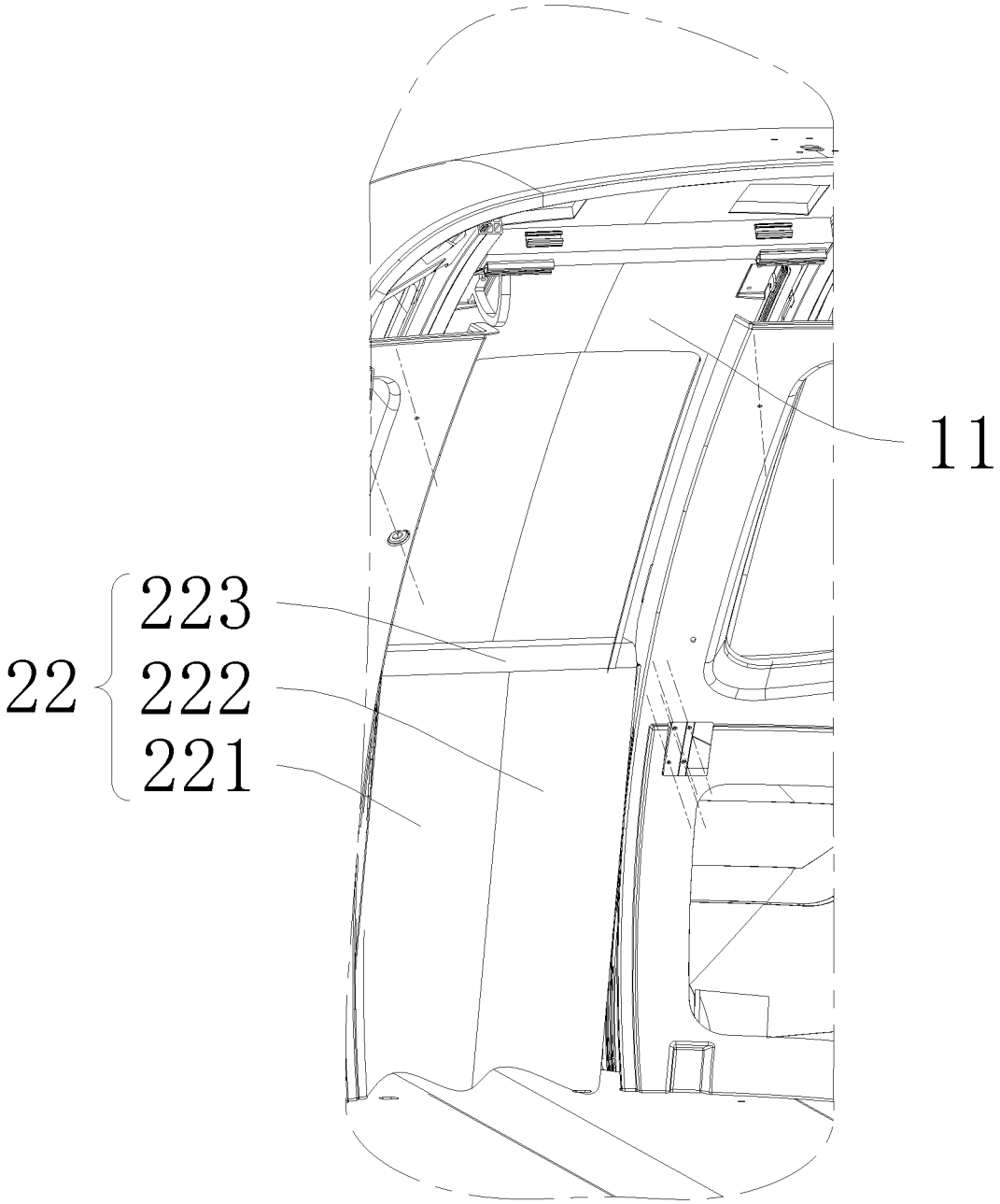
FIG. 4 is a partial schematic diagram of a rail vehicle of an embodiment of the present disclosure.

As shown in FIG. 4 and FIG. 5, the cover plate assembly 22 is split into multiple portions which are an upflipping plate 223, a left flipping plate 221, and a right flipping plate 222 respectively. The upflipping plate 223 is fixed to the escape door 11 (or a visor of the escape door 11) and can be flipped up along with the escape door 11. The left flipping plate 221 is connected to the end wall panel on the vehicle body 10 by a hinge and can rotate around a rotation shaft of the hinge. A structure of the hinge is shown in FIG. 4. As shown in FIG. 7, the escape ladder 21 and the escape door 11 are connected to multiple permanent magnets through multiple pull ropes 291. When the escape door 11 is in a withdrawn state, the pull ropes 291 are slack. After the escape door 11 is opened at a certain angle, the pull ropes 291 are taut, and the escape door 11 continues to be flipped up, driving the escape ladder 21 to be flipped down toward the outside of the vehicle. When the escape ladder 21 is flipped down to a position where a fixed point of the pull ropes 291 at the end of the permanent magnets, a fixed point of the pull ropes 291 at the end of the escape ladder 21, and a rotation point of the escape ladder 21 are in the same straight line, as shown in FIG. 8, the permanent magnets are disconnected from an attraction plate, and the escape ladder 21 is automatically flipped down in place under the action of gravity.

A structure of an overlapping part of the left flipping plate 221 and the right flipping plate 222 is shown in FIG. 7 to prevent a joint from being exposed.

As shown in FIG. 6, in a withdrawn state of the escape ladder 21 and the cover plates, the left flipping plate 221 and the right flipping plate 222 are limited by rubber limiting blocks. Automatic opening of the left flipping plate 221 and the right flipping plate 222 is realized by four springs 224. When the escape door 11 is opened, the up flipping plate 223 is flipped up along with the escape door 11, and the escape door 11 drives the escape ladder 21 to open automatically through some mechanisms. As the escape ladder 21 is flipped down, a limiting effect of the rubber limiting blocks on the left flipping plate 221 and the right flipping plate 222 disappears, and the left flipping plate 221 and the right flipping plate 222 are automatically opened in place under the action of the springs 224.

A sequence of an opening process: (1) the escape door 11 is flipped up electrically (may be also flipped up manually) to open; (2) when the escape door 11 is flipped up to open at a certain angle, pull ropes 291 are taut, driving an escape ladder 21 to be flipped down. The escape door 11 continues to be flipped up, permanent magnets are disconnected from an attraction plate, and the escape ladder 21 is automatically flipped down in place under action of gravity; (3) in a turning-down process of the escape ladder 21, the limiting effect of the rubber limiting blocks on the left flipping plate 221 and the right flipping plate 222 gradually disappears, and the left flipping plate 221 and the right flipping plate 222 automatically open in place under action of springs 224.

A withdrawing sequence: (1) the left flipping plate 221 and the right flipping plate 222 are flipped along a rotation center of a hinge so as to be withdrawn in place; (2) the escape ladder 21 is flipped up by pulling the pull ropes 291 by hand so as to be withdrawn in place; (3) the escape door 11 is pulled by hand and flipped down manually so as to be withdrawn in place; (4) the attraction plate and permanent magnets are reconnected, and the alignment of the pull ropes 291 is re-fixed.

In addition, the escape ladder 21 of the present disclosure may also include a connecting crank rod. A first end of the connecting crank rod is fixedly connected to a fixing rod 2111. A second end of the connecting crank rod is configured to be connected to the vehicle body 10. The fixing rod 2111 is arranged/disposed on the rail vehicle 100 through the connecting crank rod, which is simple in structure and facilitates switching of the escape ladder 21 between a use state and a non-use state. When the escape apparatus 20 is not used, the escape apparatus 20 is configured to stand on the vehicle body 10. In this case, the connecting crank rod may be arranged/configured in a U shape with an upward opening and toward a side of the escape ladder 21 facing away from the cover plate assembly 22. When the escape apparatus 20 is used, the connecting crank rod is arranged in a U shape with a down opening, and the connecting crank rod is constructed to be similarly hooked onto a bottom of an escape exit, thereby facilitating the improvement of structural strength and stability of the escape apparatus 20. A second end of the connecting crank rod is provided with a limiting member configured to be matched with a limiting piece of the rail vehicle 100. By matching the limiting member of the connecting crank rod with the limiting piece of the rail vehicle 100, the upper end of the escape ladder 21 may be fixed to the rail vehicle 100 when the escape ladder 21 is required to be used, so that the escape ladder 21 can be more stable for people to walk on, and shaking is avoided. The limiting member may be a limiting pin, and the limiting piece is a limiting groove or a limiting hole. In some embodiments, the limiting piece is arranged on a floor plane of the rail vehicle 100. A matching structure between the limiting pin and the limiting groove or limiting hole is simple and reliable.

Figure 9:
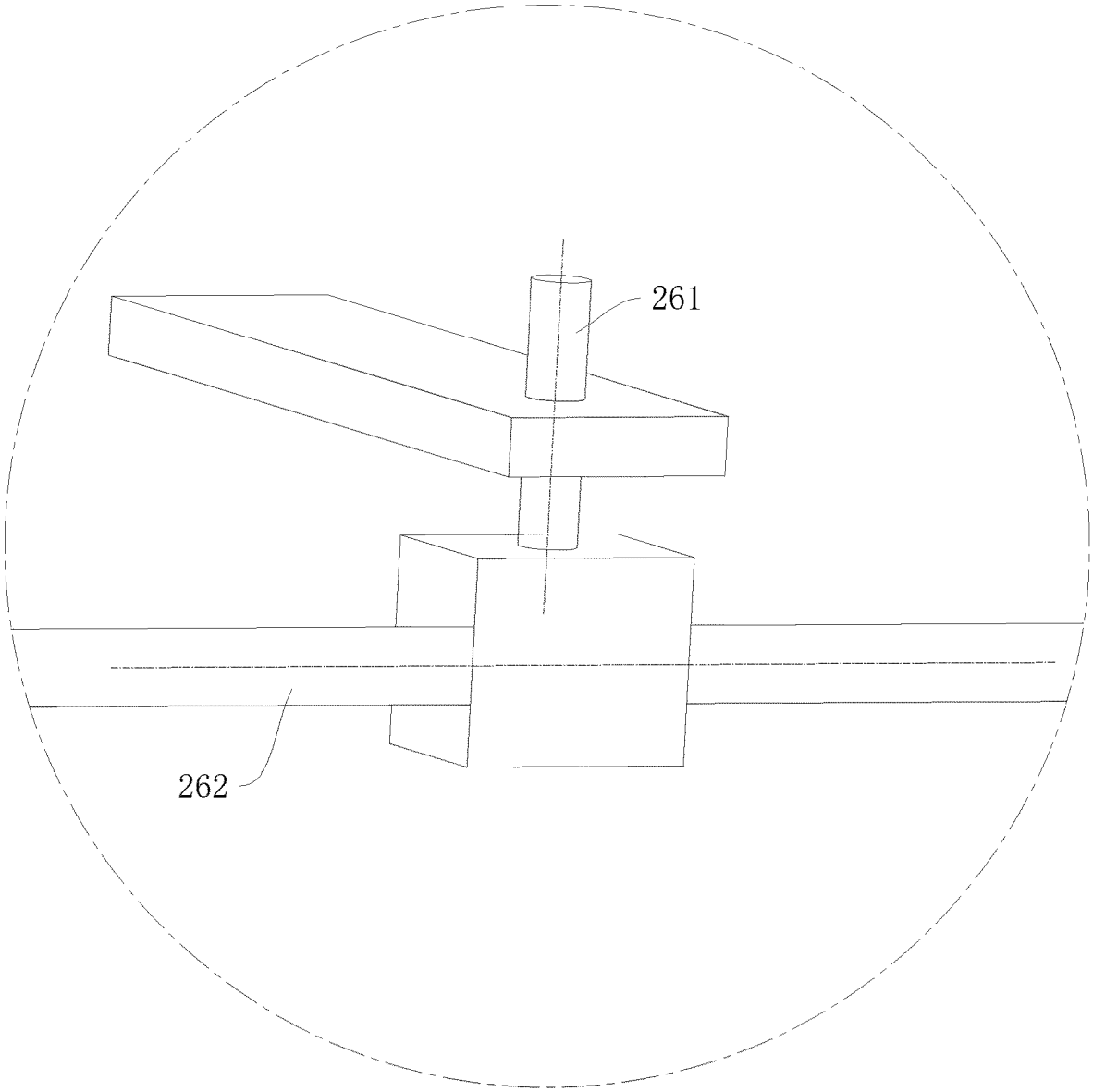
FIG. 9 is a partially enlarged schematic diagram of a region of a circle A in FIG. 8.
Figure 10:
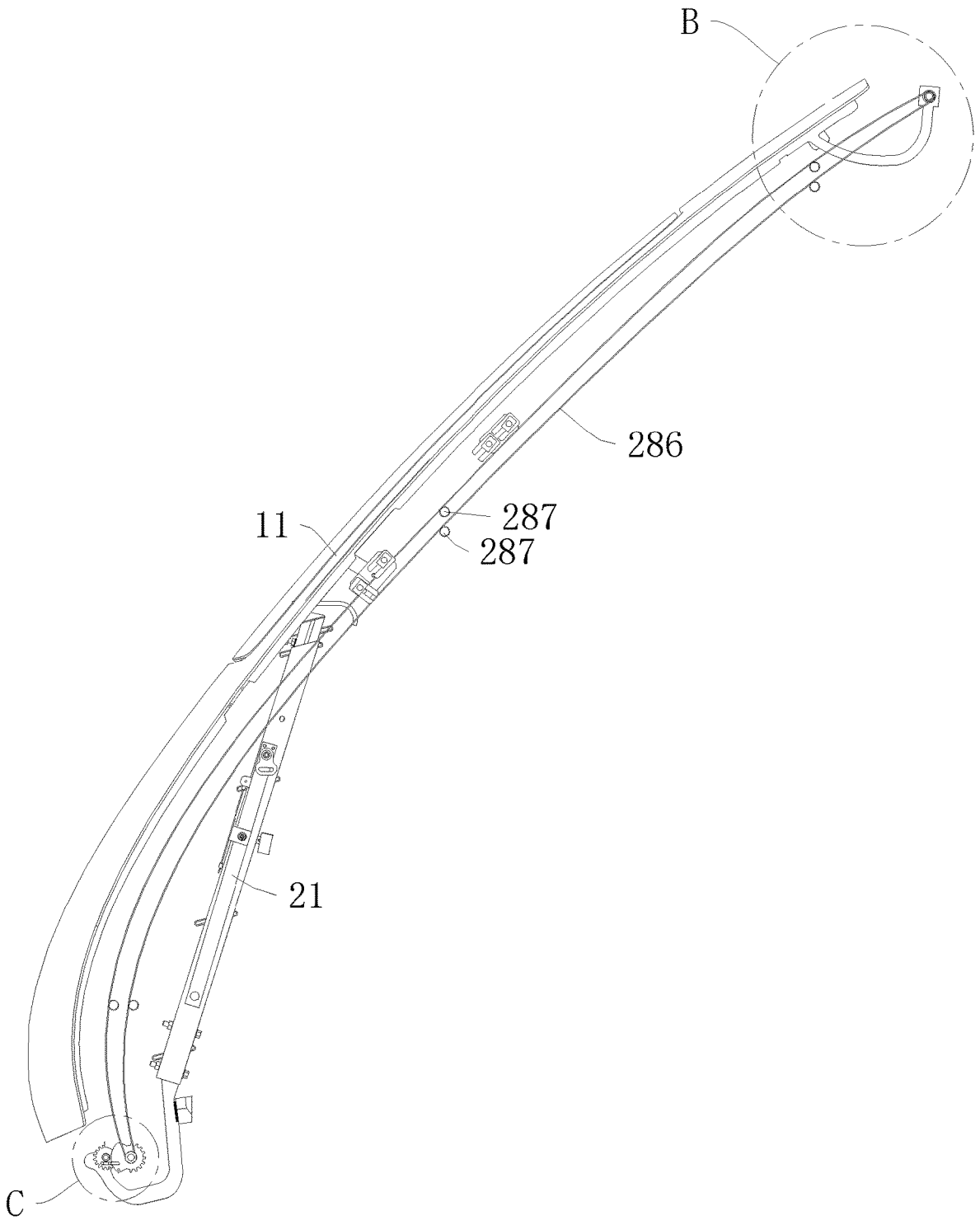
FIG. 10 is a schematic diagram of a linkage between an escape door and an escape apparatus in a rail vehicle of an embodiment of the present disclosure, where the escape apparatus is folded in the vehicle body.
Figure 11:
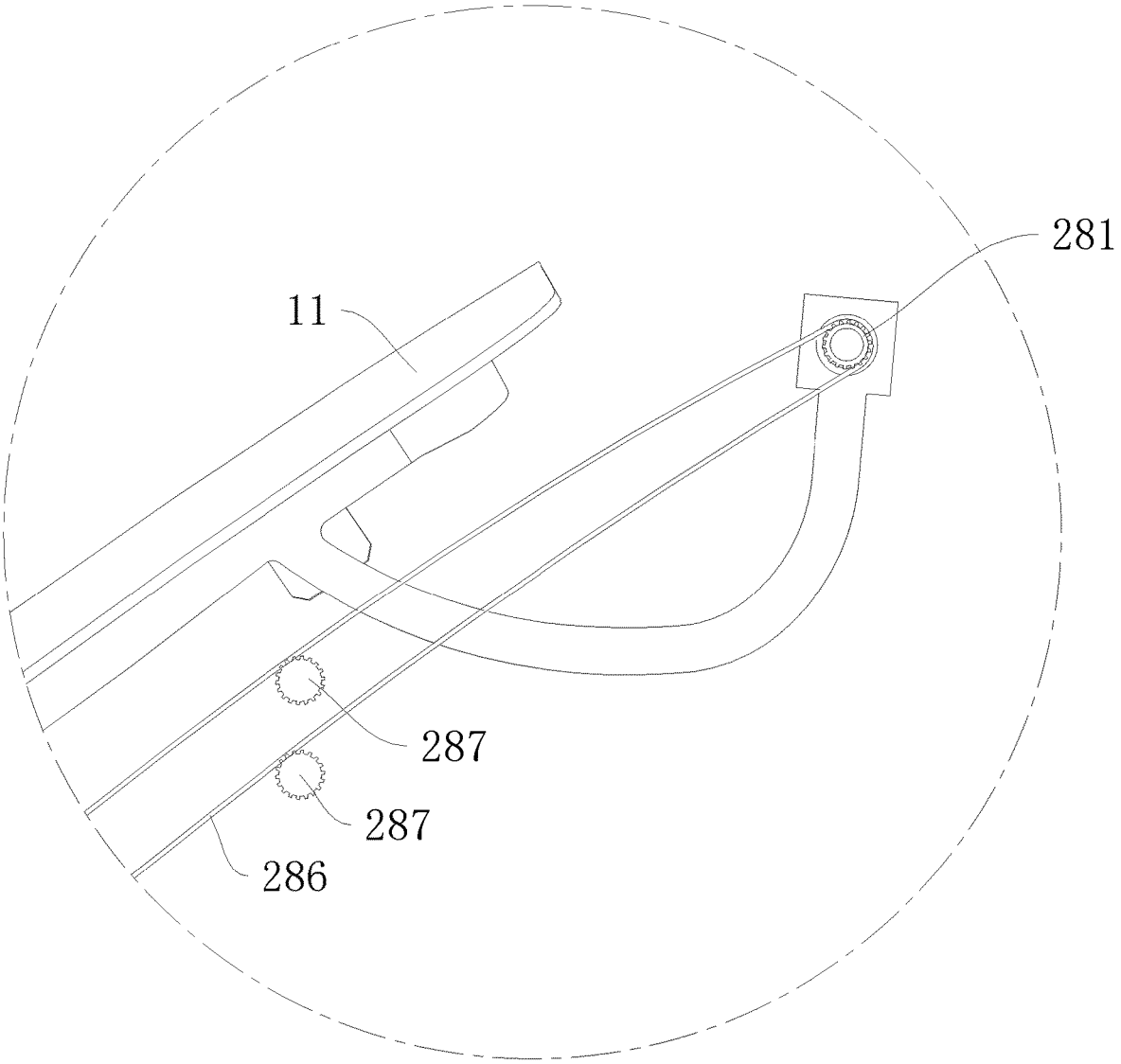
FIG. 11 is a partially enlarged schematic diagram of a region of a circle B in FIG. 10.

In an embodiment, as in FIG. 9, the escape apparatus 20 further includes a steering mechanism. The steering mechanism includes a Z-direction rotating shaft 261 and a Y-direction rotating shaft 262. The Z-direction rotating shaft 261 is configured to be rotatably connected to the vehicle body 10 about a vertical axis. The Y-direction rotating shaft 262 is connected to the Z-direction rotating shaft 261, and the Y-direction rotating shaft 262 is perpendicular to the vertical axis. The escape ladder 21 is connected to the Y-direction rotating shaft 262, and the Y-direction rotating shaft 262 is rotatable about an axis of the Y-direction rotating shaft 262 relative to the Z-direction rotating shaft 261. The Y-direction rotating shaft 262 may be arranged to be rotatably connected to the Z-direction rotating shaft 261. The Y-direction rotating shaft 262 may also be fixedly connected to the Z-direction rotating shaft 261, and the escape apparatus 20 is rotatably connected to the Y-direction rotating shaft 262. Certainly, the Y-direction rotating shaft 262 may also be rotatably connected to the Z-direction rotating shaft 261, and the escape apparatus 20 is rotatably connected to the Y-direction rotating shaft 262. By arranging/configuring the steering mechanism, steering of the escape apparatus 20 may be realized to facilitate passage.

As shown in FIG. 8, the escape ladder 21 of the present disclosure may include a fixing piece 211 and a telescoping piece 212. A first end of the fixing piece 211 is configured to be connected to the vehicle body 10. The telescoping piece 212 is telescopically connected to the fixing piece 211 between a retracted position and an extended position. The telescoping piece 212 extends from a second end of the fixing piece 211 at the extended position, so that the fixing piece 211 and the telescoping piece 212 together construct a passage. The passage in the present disclosure may be a pedal structure, a slide structure, etc. Certainly, the passage in the present disclosure may further be arranged in other forms, all of which should be within the scope of protection of the present disclosure. The present disclosure is illustrated by the example of the passage of the pedal structure, but this is not a limitation on the scope of protection of the present disclosure.

In addition, the escape ladder 21 further includes a locking mechanism, the locking mechanism is mounted on the fixing piece 211, and the locking mechanism is constructed to be configured to lock the telescoping piece 212 at the retracted position. By locking of the locking mechanism, the escape ladder 21 may be stably maintained at the retracted position, so that the escape ladder 21 can be stably folded in the vehicle body 10, and the space utilization rate is improved.

The locking mechanism may also be arranged so that locking of the escape ladder 21 may be released. For example, the locking mechanism is controlled by other control structures. In addition, to facilitate the use of the escape apparatus 20, the escape apparatus 20 may further include an unlocking mechanism.

In an embodiment, the locking mechanism includes a mounting seat and a locking member, and the mounting seat is fixedly mounted to the fixing piece 211. The locking member is rotatably connected to the mounting seat to construct a lever mechanism. The locking member has a pivot point, and a power end and a resistance end located on two sides of the pivot point. The resistance end is configured to lock the telescoping piece 212. In an embodiment, a portion of the telescoping piece 212 in the present disclosure may be connected to the fixing piece 211 in an inserted mode. When the telescoping piece 212 is retracted, one end of the locking member may penetrate through the fixing piece 211 to be connected to the telescoping piece 212 in an inserted mode, thereby implementing locking of the telescoping piece 212. Whereas the locking member is constructed in a structure of a lever, the locking member has the pivot point, and the power end and the resistance end located on the two sides of the pivot point, and the resistance end is configured to lock the telescoping piece 212. In an embodiment, a positioning post is arranged at the resistance end of the locking member. A positioning hole (not shown in the figures) is formed in a side face of the telescoping piece 212. The positioning post is configured to be inserted into the positioning hole to lock the telescoping piece 212, and the positioning post is configured to be disengaged from the positioning hole to release the telescoping piece 212. When the locking member is at a position of locking the telescoping piece 212, the locking member may be constructed in a shape of a hook so as to implement locking of the telescoping piece 212, and a locking effect on the telescoping piece may be improved. A matching hole opposite to the positioning hole may be formed in the fixing piece. During locking of the telescoping piece by the locking member, the positioning post penetrates through the matching holes to be connected to the positioning hole in an inserted mode.

In addition, the locking member of the present disclosure may be constructed in a shape of a rod. The locking member includes a first rod piece, a second rod piece, and the positioning post. The first rod piece and the second rod piece are connected at the pivot point of the locking member and are connected to the mounting seat. The positioning post is connected to the second rod piece and is perpendicular to the second rod piece. The first rod piece and the second rod piece may be constructed in an oppositely inclined extending form to allow the first rod piece to be cocked in a direction away from the fixing piece when the locating post locks the telescoping piece 212. In addition, the locking mechanism may further include an elastic structure by which a force toward locking the telescoping piece 212 is applied to the locking member.

In an embodiment, the fixing piece 211 includes a fixing rod 2111 and a first pedal 2112. A first end of the fixing rod 2111 is configured to be connected to the vehicle body 10. The first pedal 2112 is arranged on the fixing rod 2111. The first pedal 2112 is arranged on the fixing rod 2111. The fixing rod 2111 may provide support for the first pedal 2112. When the escape apparatus 20 is used, passengers may leave the vehicle via the first pedal 2112. The escape ladder 21 may include multiple first pedals 2112. The multiple first pedals 2112 are arranged obliquely at intervals from top to bottom when the escape apparatus 20 is in use. There may be one, two, three or more fixing rods 2111. When there are two fixing rods 2111, the two fixing rods 2111 may be arranged in parallel in a spaced mode, the first pedal 2112 is connected between the two fixing rods 2111, and the two ends of the first pedal 2112 are connected to the two fixing rods 2111 respectively, so that the stability and connection strength of the first pedal 2112 may be improved. Certainly, one fixing rod 2111 may also be arranged, and the fixing rod 2111 may be connected to a middle of the first pedal 2112.

In an embodiment, the telescoping piece 212 includes a telescoping rod 2121 and a second pedal 2122. The telescoping rod 2121 is telescopically connected in the fixing rod 2111 in an inserted mode. The second pedal 2122 is arranged on the telescoping rod 2121. The telescoping rod 2121 may be used as a support structure of the second pedal 2122.

In an embodiment, when the telescoping rod 2121 is at the retracted position, a spacing between the second pedal 2122 and the fixing piece 211 is small, which may reduce space occupied by the escape apparatus 20. When the telescoping rod 2121 extends out, the spacing between the second pedal 2122 and the fixing piece 211 is large, and the telescoping rod 2121 may provide support for the second pedal 2122 so as to facilitate constructing the first pedal 2112 and the second pedal 2122 as a structure of a ladder.

In the description of the present disclosure, it should be understood that orientation or position relationships indicated by the terms such as "center", "longitudinal", "transverse", "length", "width", "thickness", "on", "below", "front", "back", "left", "right", "vertical", "horizontal", "top", "bottom", "inside", "outside", "clockwise", "anticlockwise", "axial direction", "radial direction", and "circumferential direction" are based on orientation or position relationships shown in the accompanying drawings, and are used only for convenient description of the present disclosure and brevity of description, rather than indicating or implying that the mentioned apparatus or component must have a particular orientation or must be constructed and operated in a particular orientation. Therefore, such terms should not be construed as limiting of the present disclosure.

In addition, terms "first" and "second" are used merely for the purpose of description, and shall not be construed as indicating or implying relative importance or implying the quantity of indicated technical features. Therefore, a feature restricted by "first" or "second" may explicitly indicate or implicitly include at least one of such features. In description of the present disclosure, "multiple" means at least two, such as two and three unless it is clearly and defined otherwise.

In the present disclosure, unless otherwise explicitly specified or defined, the first feature being located "above" or "below" the second feature may be the first feature being in a direct contact with the second feature, or the first feature being in an indirect contact with the second feature through an intermediary. In addition, the first feature being "above", "over", or "on" the second feature may indicate that the first feature is directly above or obliquely above the second feature, or may merely indicate that a horizontal height of the first feature is greater than that of the second feature. The first feature being "below", "under", and "beneath" the second feature may be that the first feature is right below the second feature or obliquely below the second feature, or may merely indicate that the horizontal height of the first feature is less than that of the second feature.

In the descriptions of this specification, a description of a reference term such as "an embodiment", "some embodiments", "an example", "a specific example", or "some examples" means that a feature, structure, material, or characteristic that is described with reference to the embodiment or the example is included in at least one embodiment or example of this application. In this specification, schematic descriptions of the foregoing terms are not necessarily directed at the same embodiment or example. Besides, the features, the structures, the materials or the characteristics that are described may be combined in proper manners in any one or more embodiments or examples. In addition, a person skilled in the art may integrate or combine different embodiments or examples described in the specification and features of the different embodiments or examples as long as they are not contradictory to each other.

Although the embodiments of the present disclosure have been shown and described above, it can be understood that, the foregoing embodiments are examples and should not be understood as limitation to the present disclosure. A person of ordinary skill in the art can make changes, modifications, replacements, or variations to the foregoing embodiments within the scope of the present disclosure.

What is claimed is:

1. A rail vehicle, comprising:

a vehicle body comprising an escape exit;

an escape door configured to be opened and closed, and when closed, configured to close the escape exit;

an escape ladder disposed at the escape exit, and configured to be folded at a folded position on an inside of the escape door, and to extend out of the vehicle body at an unfolded position to form a passage from the vehicle body to an escape passage; and a cover plate assembly configured to be opened and closed, and when closed, configured to cover an inside-facing surface of the escape door, and the escape ladder configured to be folded at the folded position between the cover plate assembly and the escape door and covered by the cover plate assembly, wherein the cover plate assembly comprises a left flipping plate and a right flipping plate, as viewed from an inside of the vehicle body facing the escape exit, the left flipping plate is rotatably connected to a left side of the escape exit and configured to be flipped left outwardly to open the escape exit, and the right flipping plate is rotatably connected to a right side of the escape exit and configured to be flipped right outwardly to open the escape exit.

2. The rail vehicle according to claim 1, wherein the left flipping plate and the right flipping plate are configured to be shut to cover the inside of the escape door.

3. The rail vehicle according to claim 2, wherein the left flipping plate and the right flipping plate are limited by a limiting structure at a shut position to limit the left flipping plate and the right flipping plate from turning into the vehicle body.

4. The rail vehicle according to claim 2, wherein the vehicle body comprises a cover opening mechanism, and the cover opening mechanism is connected to the left flipping plate and the right flipping plate and is configured to drive the left flipping plate and the right flipping plate to open.

5. The rail vehicle according to claim 4, wherein the escape ladder supports the left flipping plate and the right flipping plate at the folded position to maintain the left flipping plate and the right flipping plate in a shut state, and the cover opening mechanism comprises a plurality of springs, a first portion of the springs has two ends that are connected to the vehicle body and the left flipping plate respectively, and a second portion of the springs has two ends that are connected to the vehicle body and the right flipping plate respectively, and the springs are configured to drive the left flipping plate and the right flipping plate to open.

6. The rail vehicle according to claim 5, wherein a first flexible limiting block is disposed between the escape ladder and the left flipping plate, and a second flexible limiting block is disposed between the escape ladder and the right flipping plate when the escape ladder is at the folded position.

7. The rail vehicle according to claim 2, wherein the left flipping plate and the right flipping plate at least partially overlap when shut.

8. The rail vehicle according to claim 7, wherein an end edge of the left flipping plate has a first notch, an end edge of the right flipping plate has a second notch, and the end edge of the left flipping plate and the end edge of the right flipping plate are connected to each other when the left flipping plate and the right flipping plate are shut.

9. The rail vehicle according to claim 2, wherein an upper end of the escape door is hinged to an upper side of the escape exit, the escape door is configured to be flipped up to open the escape exit, and the cover plate assembly further comprises:

an upward-flipping plate fixedly connected to the escape door, and configured to cover an upper portion of the escape ladder and to flip up along with the escape door.

10. The rail vehicle according to claim 9, wherein an end of the upward-flipping plate extends down and is configured to hook onto an upper end of the escape ladder; or the upward-flipping plate, the left flipping plate, and the right flipping plate have substantially coplanar exterior surfaces when covering the escape ladder.

11. The rail vehicle according to claim 1, wherein the escape door is linked with the escape ladder to drive the escape ladder to unfold when the escape door is opened.

12. The rail vehicle according to claim 11, wherein a transmission mechanism is disposed to link the escape door with the escape ladder, the transmission mechanism comprises a driving wheel, a transmission member, a driven wheel, and a synchronization belt, the driving wheel is connected to the escape door, the transmission member is connected to the vehicle body, the driven wheel is connected to the escape ladder and is in a transmission connection with the transmission member, and the synchronization belt is connected to the driving wheel and the transmission member.

13. The rail vehicle according to claim 12, wherein the transmission member further comprises a transmission wheel, and at least one of the transmission wheel and the driven wheel is a partial-toothed gear having at least a portion with teeth and a portion without teeth on its circumference, and the transmission wheel meshes with the driven wheel after the escape door is opened at a predetermined angle relative to a closed position of the escape door.

14. The rail vehicle according to claim 13, wherein the transmission wheel comprises a first gear segment and a first transition segment, the driven wheel comprises a second gear segment and a second transition segment, the transmission wheel comprises a transition rod disposed on the first transition segment, the driven wheel comprises a gear lever disposed on the second transition segment, and the transition rod and the gear lever are coupled to mesh the first gear segment with the second gear segment.

15. The rail vehicle according to claim 12, wherein the transmission mechanism further comprises a plurality of support wheels disposed on the vehicle body and supports the synchronization belt.

16. The rail vehicle according to claim 15, wherein the support wheels are disposed at the escape exit at intervals along an up-down direction, and the support wheels allow the synchronization belt to extend along the escape exit in the up-down direction.

17. The rail vehicle according to claim 1, wherein an upper end of the escape door is hinged to an upper side of the escape exit, and the escape door is configured to flip up to open the escape exit, and the escape door comprises a first magnetic member, the escape ladder comprises a pull rope, the pull rope comprises a second magnetic member configured to attract the first magnetic member, and the escape door is configured to drive the escape ladder to flip outwards through the pull rope when the escape door opens.

18. The rail vehicle according to claim 1, further comprising:

a first support rod connected to the escape ladder;

a second support rod rotatably connected to the vehicle body; and a positioning mechanism connected to the escape ladder, the first support rod, the second support rod, and the vehicle body, wherein when the escape ladder is folded, the first support rod is folded on the escape ladder, and the second support rod is folded on the vehicle body, and when the escape ladder is unfolded, the first support rod is supported on the escape ladder, and the second support rod is supported on the vehicle body.

19. The rail vehicle according to claim 18, wherein the positioning mechanism comprises a first connecting rope, a second connecting rope, and a third connecting rope, the first connecting rope is connected to the escape ladder and the first support rod, the second connecting rope is connected to the first support rod and the second support rod, and the third connecting rope is connected to the second support rod and the vehicle body.

20. The rail vehicle according to claim 18, wherein the escape ladder further comprises:

a positioning seat disposed on the escape ladder, and the positioning seat is configured to engage the first support rod and to limit movement of the first support rod toward the cover plate assembly when the escape ladder is at the folded position.

21. The rail vehicle according to claim 1, wherein the escape ladder is connected to the vehicle body through a steering mechanism, the steering mechanism comprising:

a Z-direction rotating shaft rotatably connected to the vehicle body about a vertical axis; and a Y-direction rotating shaft connected to the Z-direction rotating shaft and perpendicular to the vertical axis, wherein the escape ladder is connected to the Y-direction rotating shaft, and the Y-direction rotating shaft is rotatable about an axis of the Y-direction rotating shaft relative to the Z-direction rotating shaft.

* * * * *